US011581648B2

(12) United States Patent
Murch et al.

(10) Patent No.: US 11,581,648 B2
(45) Date of Patent: Feb. 14, 2023

(54) MULTI-PORT ENDFIRE BEAM-STEERABLE PLANAR ANTENNA

(71) Applicant: The Hong Kong University of Science and Technology, Hong Kong (CN)

(72) Inventors: Ross David Murch, Hong Kong (CN); Chi Yuk Chiu, Hong Kong (CN); Wei Xie, Hong Kong (CN); Yujie Zhang, Hong Kong (CN); Shanpu Shen, Jiangsu (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 50 days.

(21) Appl. No.: 17/327,186

(22) Filed: May 21, 2021

(65) Prior Publication Data

US 2021/0384629 A1 Dec. 9, 2021

Related U.S. Application Data

(60) Provisional application No. 63/204,145, filed on Sep. 16, 2020, provisional application No. 63/102,295, filed on Jun. 8, 2020.

(51) Int. Cl.

| | |
|---|---|
| ***H01Q 5/49*** | (2015.01) |
| ***H01Q 21/06*** | (2006.01) |
| ***H01Q 5/385*** | (2015.01) |

(52) U.S. Cl.

CPC ..... *H01Q 5/49* (2015.01); *H01Q 5/385* (2015.01); *H01Q 21/062* (2013.01)

(58) Field of Classification Search

CPC ..... H01Q 5/49; H01Q 5/385; H01Q 21/062; H01Q 19/30; H01Q 3/446; H01Q 1/36; H01Q 3/24; H01Q 21/24

See application file for complete search history.

(56) References Cited

U.S. PATENT DOCUMENTS 5,510,803 A 4/1996 Ishizaka et al.
5,564,484 A 10/1996 Ketonen
(Continued)

FOREIGN PATENT DOCUMENTS

KR 101390168 B1 * 4/2014 ..... H01Q 21/20
WO WO-02084801 A1 * 10/2002 ..... H01Q 13/10
(Continued)

OTHER PUBLICATIONS

Hossain, M. et al., "Parasitic Layer-Based Radiation Pattern Reconfigurable Antenna for 5G Communications," *IEEE Transactions on Antennas Propagation*, vol. 65, No. 12, pp. 6444-6452, (Dec. 2017).
(Continued)

*Primary Examiner* — Hoang V Nguyen
(74) *Attorney, Agent, or Firm* — Leydig, Voit & Mayer, Ltd.

(57) ABSTRACT

A multiport planar antenna system with digital reconfigurability to adjust a beam-steering function of the system is described herein. A substrate is provided and a grid of parasitic elements is printed on a surface of the substrate. One or more driven, radiating elements such as monopole or dipole antennas are printed on the substrate proximate the parasitic elements. Switching elements between adjacent parasitic elements are then configured to steer the radiation direction in a particular direction in the azimuth plane. The small form factor of the planar antenna system can be used in a multiple-input, multiple-output (MIMO) application used by fifth generation (5G) devices such as mobile phones, internet of things (IoT) devices, and vehicles.

18 Claims, 28 Drawing Sheets

(56) References Cited

U.S. PATENT DOCUMENTS

| | | | | |
|---|---|---|---|---|
| 6,198,438 | B1 | 3/2001 | Herd et al. | |
| 6,603,436 | B2 | 8/2003 | Heinz et al. | |
| 6,965,355 | B1 | 11/2005 | Durham et al. | |
| 7,245,269 | B2 | 7/2007 | Sievenpiper et al. | |
| 7,522,102 | B2 | 4/2009 | Shi | |
| 8,149,166 | B1 | 4/2012 | Buxa | |
| 8,354,972 | B2 | 1/2013 | Borja et al. | |
| 8,368,609 | B2 | 2/2013 | Morrow et al. | |
| 8,446,326 | B2 | 5/2013 | Tietjen | |
| 8,514,130 | B1 * | 8/2013 | Jensen | H01Q 19/32 342/367 |
| 8,564,484 | B2 | 10/2013 | Jan et al. | |
| 8,854,257 | B2 | 10/2014 | Hamner et al. | |
| 9,263,803 | B1 | 2/2016 | Weller et al. | |
| 9,379,449 | B2 | 6/2016 | Cetiner et al. | |
| 9,577,346 | B2 | 2/2017 | Shtrom et al. | |
| 9,972,916 | B2 | 5/2018 | Yang et al. | |
| 10,734,737 | B2 | 8/2020 | Shtrom et al. | |
| 2002/0084943 | A1 | 7/2002 | Tsai et al. | |
| 2003/0038748 | A1 | 2/2003 | Henderson et al. | |
| 2003/0043071 | A1 | 3/2003 | Lilly et al. | |
| 2005/0001784 | A1 | 1/2005 | Oliver et al. | |
| 2005/0030238 | A1 | 2/2005 | Brown et al. | |
| 2011/0001682 | A1 | 1/2011 | Rao | |
| 2013/0050037 | A1 * | 2/2013 | Takemura | H01Q 19/28 343/837 |
| 2015/0116154 | A1 | 1/2015 | Wang et al. | |
| 2016/0028166 | A1 | 1/2016 | Le et al. | |
| 2017/0309991 | A1 | 10/2017 | Noori et al. | |
| 2018/0040960 | A1 | 2/2018 | Johnson et al. | |
| 2018/0069324 | A1 | 3/2018 | Arfaei Malekzadeh et al. | |

FOREIGN PATENT DOCUMENTS

| | | | | |
|---|---|---|---|---|
| WO | WO 2013106106 | A2 | 7/2013 | |
| WO | WO-2015129089 | A1 * | 9/2015 | H01Q 21/0081 |
| WO | WO 2018/119153 | A2 | 6/2018 | |

OTHER PUBLICATIONS

Hong, W., et al., "Design and Analysis of a Low-Profile 28 GHz Beam Steering Antenna Solution for Future 5G Cellular Application" *IEEE Conference Publication*, (4 pages), (2014).

Poshtgol, P., et al., "Printed High Gain End-Fire Beam-Steerable Yagi Antenna", *IEEE Conference*, pp. 163-164, (2017).

Lotfi, Parisa et al., "Printed Endfire Beam-Steerable Pixel Antenna", *IEEE Transactions on Antennas and Propagation*, vol. 65, No. 8, pp. 3913-3923, (Aug. 2017).

Hu, Jun et al., "A Wideband Array Antenna with 1-Bit Digital-Controllable Radiation Beams", *IEEE Access*, vol. 6, pp. 10858-10866 (2018).

Haider, Nadia et al., "L/S-Band Frequency Reconfigurable Multiscale Phased Array Antenna with Wide Angle Scanning", *IEEE Transaction on Antennas and Propagation*, vol. 65, No. 9, pp. 4519-4528, (Sep. 2017).

Quan, X.L. et al., "Development of a Broadband Horizontally Polarized Omnidirectional Planar Antenna and its Array for Base Stations", *Progress in Electromagnetic Research* vol. 128, pp. 441-456, (2012).

Hsu, Y.W., et al., Dual-Polarized Quasi Yagi-Uda Antennas with Endfire Radiation for Millimeter-Wave MIMO Terminals, *IEEE Transactions on Antennas and Propagation*, vol. 65, No. 12, pp. 6282-6289 (Dec. 2017).

Gao, W., et al., Horizontally Polarized 360° Beam-Steerable Frequency-Reconfigurable Antenna, *IEEE Transactions and Propagation*, vol. 67, No. 8, pp. 5231-5242 (Aug. 2019).

Li, Z., et al., "A Beam-Steering Reconfigurable Antenna for WLAN Applications" *IEEE Transaction on Antennas and Propagation*, vol. 63, No. 1, pp. 24-32, (Jan. 2015).

Lotfi, P., et al., "Printed Endfire Beam-Steerable Pixel Antenna," *IEEE Trans. Antennas Propagation*, vol. 65, No. 8, pp. 3913-3923, (Aug. 8, 2017).

Xie, Wei, et al., "A Planar Pattern-reconfigurable Antenna for IEEE 802.11 ax Applications," *IEEE Antennas Propagation Society International Symposium* pp. 323-324, (Jul. 2020).

Yu, Y., "A Wideband Omnidirectional Horizontally Polarized Antenna for 4G-LTE Applications", *IEEE Antennas and Wireless Propagation Letters*,vol. 12, pp. 686-689, (2013).

Wang, Z.D., et al., "Design of a Wideband Horizontally Polarized Omnidirectional Antenna with Mutual Coupling Method", *IEEE Transactions on Antennas and Propagation* vol. 63, No. 7, pp. 3311-3316 (Jul. 2015).

* cited by examiner

300

| Gap No. | Closed Yes/ No | Gap No. | Closed Yes/ No | Gap No. | Closed Yes/ No |
|---|---|---|---|---|---|
| 1 | Yes | 2 | Yes | 3 | No |
| 4 | No | 5 | No | 6 | Yes |
| 7 | No | 8 | No | 9 | No |
| 10 | No | 11 | No | 12 | Yes |
| 13 | No | 14 | No | 15 | No |
| 16 | No | 17 | Yes | 18 | No |
| 19 | No | 20 | No | 21 | Yes |
| 22 | No | 23 | No | 24 | No |
| 25 | No | 26 | Yes | 27 | Yes |
| 28 | No | 29 | No | 30 | No |
| 31 | No | 32 | No | 33 | No |
| 34 | No | 35 | No | 36 | Yes |
| 37 | No | 38 | No | 39 | No |
| 40 | No | 41 | No | 42 | Yes |
| 43 | Yes | 44 | No | 45 | No |
| 46 | No | 47 | No | 48 | Yes |
| 49 | No | 50 | No | 51 | Yes |
| 52 | Yes | 53 | No | 54 | No |
| 55 | No | 56 | No | 57 | Yes |
| 58 | No | 59 | No | 60 | No |

*Fig. 3A*

310

| Gap No. | Closed Yes/ No | Gap No. | Closed Yes/ No | Gap No. | Closed Yes/ No |
|---|---|---|---|---|---|
| 1 | Yes | 2 | No | 3 | No |
| 4 | No | 5 | No | 6 | No |
| 7 | Yes | 8 | No | 9 | No |
| 10 | No | 11 | No | 12 | Yes |
| 13 | No | 14 | No | 15 | No |
| 16 | Yes | 17 | No | 18 | No |
| 19 | No | 20 | No | 21 | Yes |
| 22 | Yes | 23 | No | 24 | No |
| 25 | No | 26 | No | 27 | No |
| 28 | No | 29 | No | 30 | No |
| 31 | Yes | 32 | No | 33 | No |
| 34 | No | 35 | No | 36 | No |
| 37 | Yes | 38 | Yes | 39 | No |
| 40 | No | 41 | No | 42 | No |
| 43 | Yes | 44 | No | 45 | No |
| 46 | Yes | 47 | Yes | 48 | No |
| 49 | No | 50 | No | 51 | No |
| 52 | Yes | 53 | No | 54 | No |
| 55 | No | 56 | Yes | 57 | Yes |
| 58 | No | 59 | No | 60 | No |

*Fig. 3B*

320

| Gap No. | Closed Yes/ No | Gap No. | Closed Yes/ No | Gap No. | Closed Yes/ No |
|---|---|---|---|---|---|
| 1 | No | 2 | Yes | 3 | No |
| 4 | No | 5 | No | 6 | No |
| 7 | Yes | 8 | No | 9 | No |
| 10 | No | 11 | Yes | 12 | No |
| 13 | No | 14 | No | 15 | No |
| 16 | Yes | 17 | Yes | 18 | No |
| 19 | No | 20 | No | 21 | No |
| 22 | No | 23 | No | 24 | No |
| 25 | No | 26 | Yes | 27 | No |
| 28 | No | 29 | No | 30 | No |
| 31 | No | 32 | Yes | 33 | Yes |
| 34 | No | 35 | No | 36 | No |
| 37 | No | 38 | Yes | 39 | No |
| 40 | No | 41 | Yes | 42 | Yes |
| 43 | No | 44 | No | 45 | No |
| 46 | No | 47 | Yes | 48 | No |
| 49 | No | 50 | No | 51 | Yes |
| 52 | Yes | 53 | No | 54 | No |
| 55 | No | 56 | Yes | 57 | No |
| 58 | No | 59 | No | 60 | No |

*Fig. 3C*

700

| Gap No. | Closed Yes/ No | Gap No. | Closed Yes/ No | Gap No. | Closed Yes/ No |
|---|---|---|---|---|---|
| 1 | Yes | 2 | Yes | 3 | Yes |
| 4 | Yes | 5 | Yes | 6 | No |
| 7 | No | 8 | No | 9 | No |
| 10 | No | 11 | No | 12 | No |
| 13 | No | 14 | No | 15 | No |
| 16 | Yes | 17 | Yes | 18 | No |
| 19 | Yes | 20 | Yes | 21 | Yes |
| 22 | Yes | 23 | No | 24 | Yes |
| 25 | Yes | 26 | Yes | 27 | No |
| 28 | Yes | 29 | Yes | 30 | No |
| 31 | Yes | 32 | Yes | 33 | No |
| 34 | Yes | 35 | No | 36 | Yes |

*Fig. 7A*

710

| Gap No. | Closed Yes/ No | Gap No. | Closed Yes/ No | Gap No. | Closed Yes/ No |
|---|---|---|---|---|---|
| 1 | Yes | 2 | Yes | 3 | No |
| 4 | No | 5 | No | 6 | No |
| 7 | No | 8 | No | 9 | No |
| 10 | No | 11 | No | 12 | No |
| 13 | Yes | 14 | Yes | 15 | No |
| 16 | Yes | 17 | Yes | 18 | Yes |
| 19 | Yes | 20 | No | 21 | Yes |
| 22 | Yes | 23 | Yes | 24 | No |
| 25 | Yes | 26 | Yes | 27 | No |
| 28 | Yes | 29 | Yes | 30 | No |
| 31 | Yes | 32 | No | 33 | Yes |
| 34 | Yes | 35 | Yes | 36 | Yes |

*Fig. 7B*

720

| Gap No. | Closed Yes/ No | Gap No. | Closed Yes/ No | Gap No. | Closed Yes/ No |
|---|---|---|---|---|---|
| 1 | No | 2 | No | 3 | No |
| 4 | No | 5 | No | 6 | No |
| 7 | No | 8 | No | 9 | No |
| 10 | Yes | 11 | Yes | 12 | No |
| 13 | Yes | 14 | Yes | 15 | Yes |
| 16 | Yes | 17 | No | 18 | Yes |
| 19 | Yes | 20 | Yes | 21 | No |
| 22 | Yes | 23 | Yes | 24 | No |
| 25 | Yes | 26 | Yes | 27 | No |
| 28 | Yes | 29 | No | 30 | Yes |
| 31 | Yes | 32 | Yes | 33 | Yes |
| 34 | Yes | 35 | Yes | 36 | No |

*Fig. 7C*

1600

| | |
|---|---|
| 0° | 1 2 5 6 8 10 12 15 16 17 18 20 21 27 28 31 34 35 36 38 43 44 48 49 |
| 30° | 1 6 8 13 16 17 18 19 21 23 28 29 30 31 32 35 38 39 41 42 43 45 46 49 |
| 60° | 1 2 6 7 12 13 17 24 25 28 36 37 38 39 41 42 47 |
| 90° | 3 7 11 17 18 19 21 22 29 30 31 33 40 42 44 |
| 300° | 1 4 5 6 7 8 9 10 11 12 16 17 19 20 21 25 29 31 32 35 36 39 40 42 45 47 49 |
| 330° | 1 2 4 6 7 8 10 12 15 16 17 22 24 29 33 35 36 38 42 43 45 46 47 48 |

*Fig. 16B*

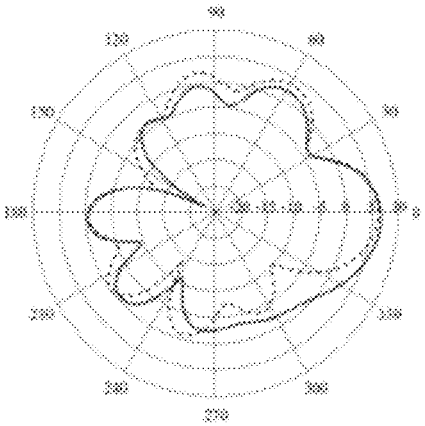
*Fig. 19A*
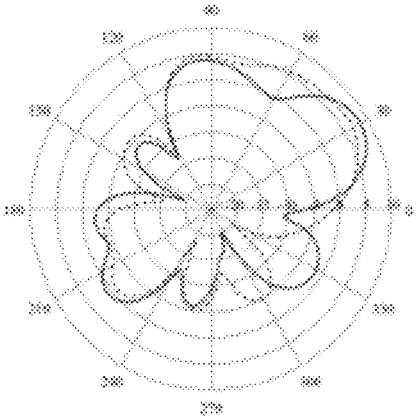
*Fig. 19B*
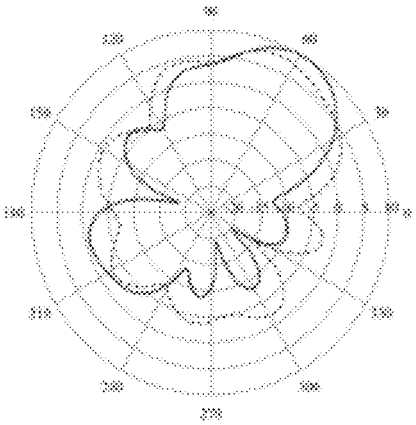
*Fig. 19C*
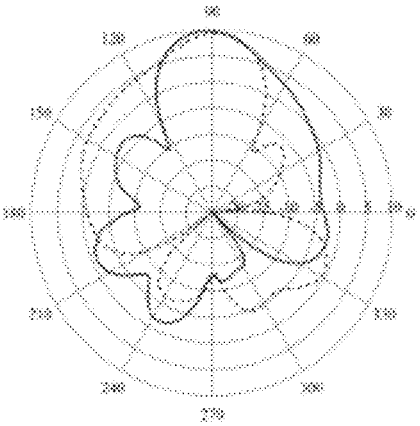
*Fig. 19D*
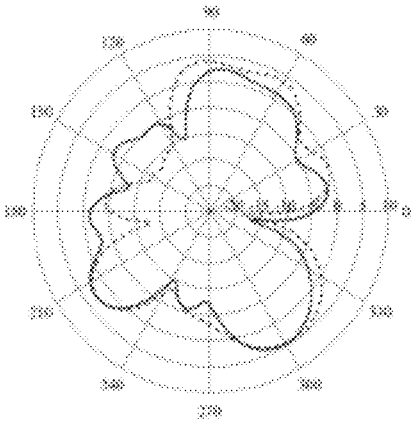
*Fig. 19E*
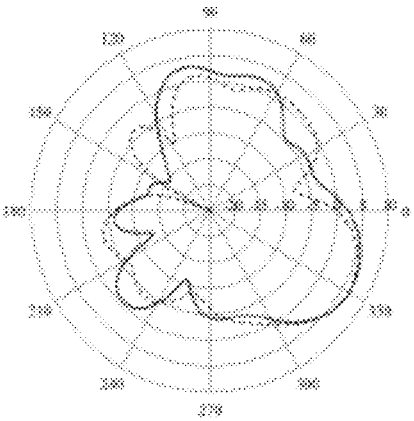
*Fig. 19F*
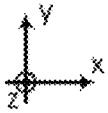

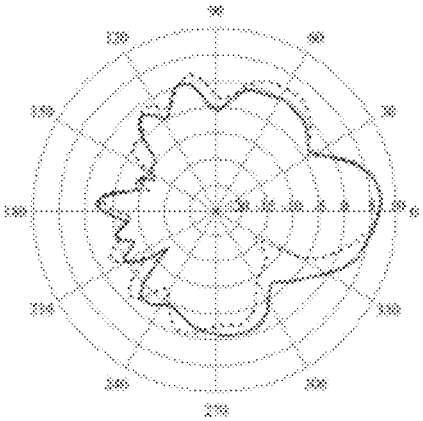
*Fig. 20A*
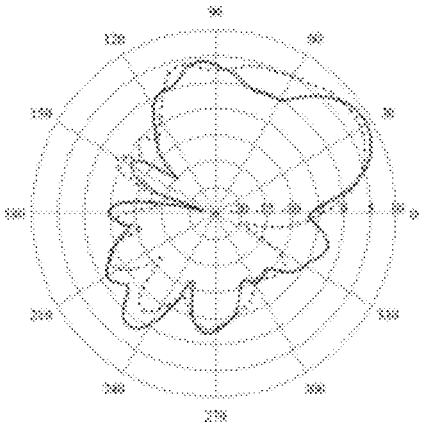
*Fig. 20B*
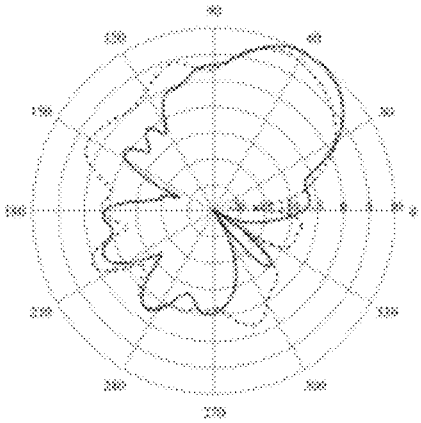
*Fig. 20C*
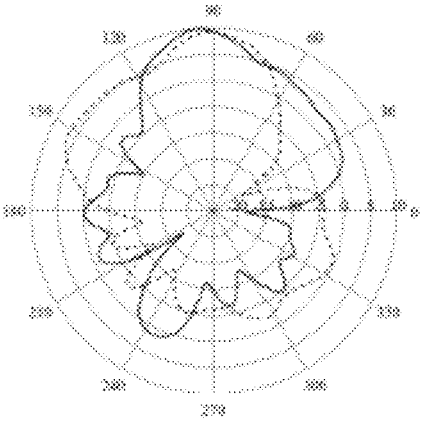
*Fig. 20D*
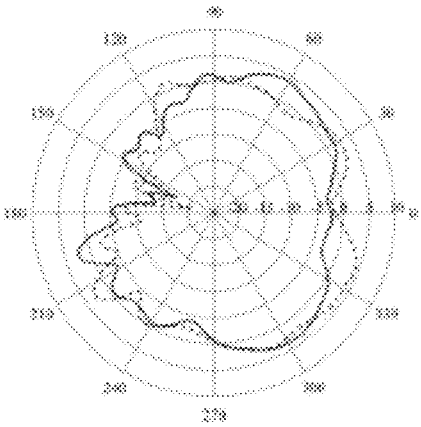
*Fig. 20E*
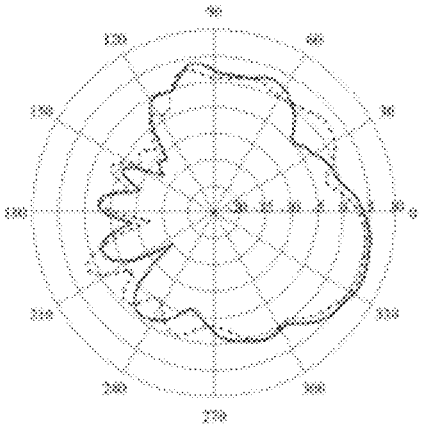
*Fig. 20F*
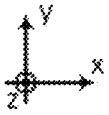

MULTI-PORT ENDFIRE BEAM-STEERABLE PLANAR ANTENNA

CROSS-REFERENCE TO RELATED APPLICATIONS

This application claims priority to U.S. Provisional Application No. 63/102,295, filed on Jun. 8, 2020, and U.S. Provisional Application No. 63/204,145, filed on Sep. 16, 2020, which are hereby incorporated by reference in their entirety.

TECHNICAL FIELD

The application relates to antennas. More specifically, the application is directed to multi-port endfire beam-steerable planar antennas.

BACKGROUND V

Wireless communication systems for transmitting and receiving radio wave signals over an air interface have been widely adopted in consumer electronics and other devices. Antenna performance can alter the quality of service of these devices significantly. Multiple-input, multiple-output (MIMO) antenna technology have emerged as a promising technology to enhance quality of service of these devices. In addition, beam-steering can also significantly enhance the signal to noise ratio (SNR) over a particular channel. However, the state of a wireless channel is always dynamic due to mobility of the device, multi-path propagation due to obstacles in the environment, and the like. Even when the device is fixed, the objects in the environment may move, thereby changing the state of the channel.

A new revision of the IEEE (Institute of Electrical and Electronics Engineers) 802.11 wireless local area network (LAN) standard, 802.11ax, which may also be referred to as High Efficiency Wireless (HEW), improves the average throughput per user by a factor of at least 4 in dense user environments. Multi-user MIMO (MU-MIMO) allows for simultaneous beam-steering for multiple clients in both the uplink and the downlink. Antennas can be designed to be reconfigurable to be able to enhance performance in terms of frequency, spatial, and polarization domains. However, the form-factor of various devices such as cell phones or wireless routers is typically a planar format, which may allow beam steering in the planar direction but not in both a planar direction as well as azimuth, to account for the three-dimensional nature of the natural environment.

Conventional beam-steerable MIMO devices may rely on phase shifting a plurality of radiator elements. For example, each of a plurality of dipole antennas may send the same signal at offset phases to form a plane wave that travels in a particular direction. At any position relative to the antenna array, the in-phase signals are amplified and the out-of-phase signals are canceled, thereby forming a strong beam in one direction while the signal in other directions is significantly weakened. However, phased antenna arrays like this have disadvantages such as limited scanning range (i.e., the beam-steering range may be limited to, e.g., 120 degrees in azimuth), a complex structure (e.g., each radiator element is connected to a separate delay element or phase shifter), and high power loss. Other methods for beam-steering can include mechanical mechanisms or use of a lens that are not suitable for planar structure applications. Thus, there is a need to develop multi-port, beam-steerable planar antennas that provide polarization diversity and beam-steering angles that cover 360 degrees in the azimuth plane.

SUMMARY

A multi-port, endfire, beam-steerable planar antenna system is described herein. In accordance with one aspect of the disclosure, an apparatus is described that includes a substrate, at least one radiating element, a plurality of parasitic elements, and a plurality of switching elements. The at least one radiating element is formed on a surface of the substrate, and each radiating element is driven by a radio frequency (RF) signal. The plurality of parasitic elements is formed on the substrate proximate the at least one radiating element. Each switching element in the plurality of switching elements corresponds to at least one parasitic element in the plurality of parasitic elements.

In an embodiment, the plurality of parasitic elements includes a grid of metallic pixels having a number of rows and a number of columns. In another embodiment, the plurality of parasitic elements includes a number of concentric rings of metallic regions.

In accordance with a second aspect of the disclosure, a system is described that includes a first antenna system and a second antenna system. The first antenna system includes a planar antenna configured to generate a radiation pattern in accordance with a first polarization. The second antenna system includes a planar antenna configured to generate a radiation pattern in accordance with a second polarization that is orthogonal to the first polarization. The first antenna system includes a first substrate and the second antenna system includes a second substrate, and the first substrate and the second substrate are arranged in a stacked configuration and separated by a distance.

BRIEF DESCRIPTION OF THE DRAWINGS

FIG. 3A depicts a table indicating a configuration of switches of the endfire beam-steerable horizontally polarized planar antenna corresponding to a beam direction of zero degrees ($\Phi=0°$), in accordance with some embodiments.

FIG. 3B depicts a table indicating a configuration of switches of the endfire beam-steerable horizontally polarized planar antenna corresponding to a beam direction of thirty degrees ($\Phi=30°$), in accordance with some embodiments.

FIG. 3C depicts a table indicating a configuration of switches of the endfire beam-steerable horizontally polarized planar antenna corresponding to a beam direction of sixty degrees ($\Phi=60°$), in accordance with some embodiments.

FIG. 7A depicts a table indicating a configuration of switches of the endfire beam-steerable vertically polarized planar antenna corresponding to a beam direction of zero degrees (Φ=0°), in accordance with some embodiments.

FIG. 7B depicts a table indicating a configuration of switches of the endfire beam-steerable vertically polarized planar antenna corresponding to a beam direction of thirty degrees (Φ=30°), in accordance with some embodiments.

FIG. 7C depicts a table indicating a configuration of switches of the endfire beam-steerable vertically polarized planar antenna corresponding to a beam direction of sixty degrees (Φ=60°), in accordance with some embodiments.

FIG. 16B depicts a table indicating a configuration of switches of the antenna system corresponding to different beam directions, in accordance with some embodiments.

FIGS. 19A-19F depict graphs of a simulated total E-field pattern of the antenna system corresponding to the beam direction of Φ=0°, 30°, 60°, 90°, 300°, and 330°, respectively, in accordance with some embodiments.

FIGS. 20A-20F depict graphs of a measured total E-field pattern of the antenna system corresponding to the beam direction of Φ=0°, 30°, 60°, 90°, 300°, and 330°, respectively, in accordance with some embodiments.

DETAILED DESCRIPTION

This disclosure relates to a multi-port, endfire beam-steerable planar antenna system. In one embodiment, the planar antenna system includes two separate planar antenna elements that correspond to horizontally polarized and vertically polarized radiation, respectively. The beam-steering mechanism of the antenna system is based on the configuration of parasitic elements that are located outside the radiating elements (e.g., monopole or dipole antennas) printed on a substrate. The parasitic elements are made of a metallic material and distributed around the radiating elements.

By configuring the parasitic elements as directors and/or reflectors, radiation beams can be controlled and steered around 360 degrees in the azimuth plane. As used herein, the azimuth plane may refer to a plane of the substrate on which the antenna system is printed. Endfire radiation can refer to any direction extending along the azimuth plane.

The two polarized radiation beams from a dual-polarized system can be controlled separately and steered to the same angle of direction or different angles of direction in accordance with the states of the various channels of wireless communication. Electronic beam-steering control can be realized when digitally controlled switching elements are employed to control connections between parasitic elements. Controlling the beam-forming ability of the antenna system can increase the signal to noise ratio (SNR) in wireless transmission. In addition, due to the orthogonality of the polarization, the two antennas can achieve low mutual coupling, which is a key factor for multiple-input, multiple-output (MIMO) applications.

Figure 1:
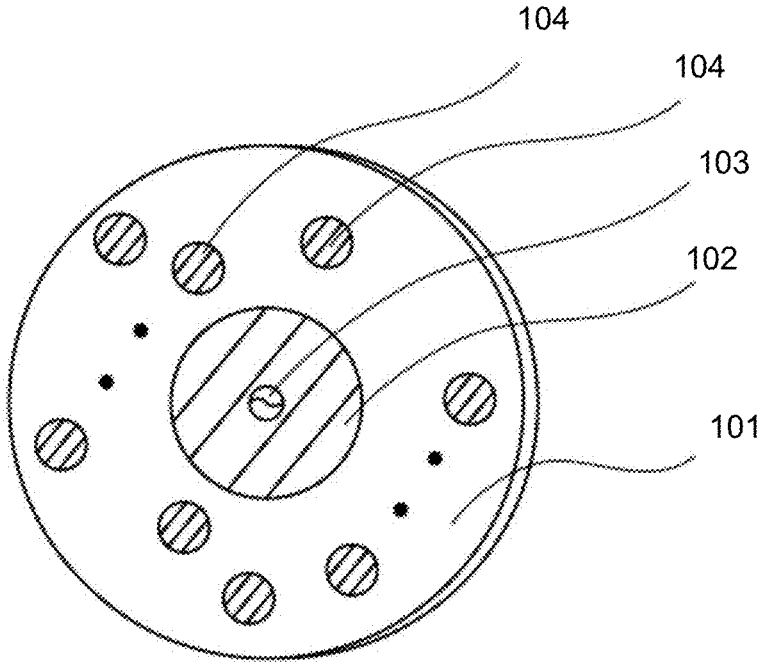
FIG. 1 illustrates an endfire beam-steerable planar antenna, in accordance with some embodiments.

FIG. 1 illustrates an endfire beam-steerable planar antenna 100, in accordance with some embodiments. As depicted in FIG. 1, the antenna 100 includes a substrate 101 comprising dielectric material. The substrate 101 can be a circular board of, e.g., glass-reinforced epoxy such as FR-4 dielectric material, although any other suitable dielectric material is within the scope of this disclosure.

The antenna 100 also includes a radiating element 102, antenna feed element 103, and certain parasitic elements 104. The radiating element 102 is located at the center of the substrate 101 and can be printed on the substrate 101 material by, e.g., photolithographic processes (i.e., photolithography). The radiating element 102 can be used for generating horizontally polarized or vertically polarized radiations, depending on the structure of the radiating element 102 and the corresponding radiation mechanism.

The antenna feed 103 is used to excite the radiating element 102, and can also be referred to as an interface such as a SubMiniature version A (SMA) connector for connecting other radio frequency (RF) devices.

The parasitic elements 104 are made of a metallic material and can also be printed on the substrate 101 via photolithographic processes. The parasitic elements 104 are not limited to any specific shape or number of elements, but may be distributed or arranged around the radiating element 102.

The operation of the antenna 100 essentially allows for reconfiguring the parasitic elements 104 to form different Yagi-Uda antennas pointing to various directions on the azimuth plane. The parasitic elements 104 can be jointed together as directors in the front direction and/or as reflectors in the back direction. Thus, by changing the configuration of parasitic elements 104 via switching elements, the antenna 100 can be adjusted to steer the radiation beam in a new direction.

Figure 2A:
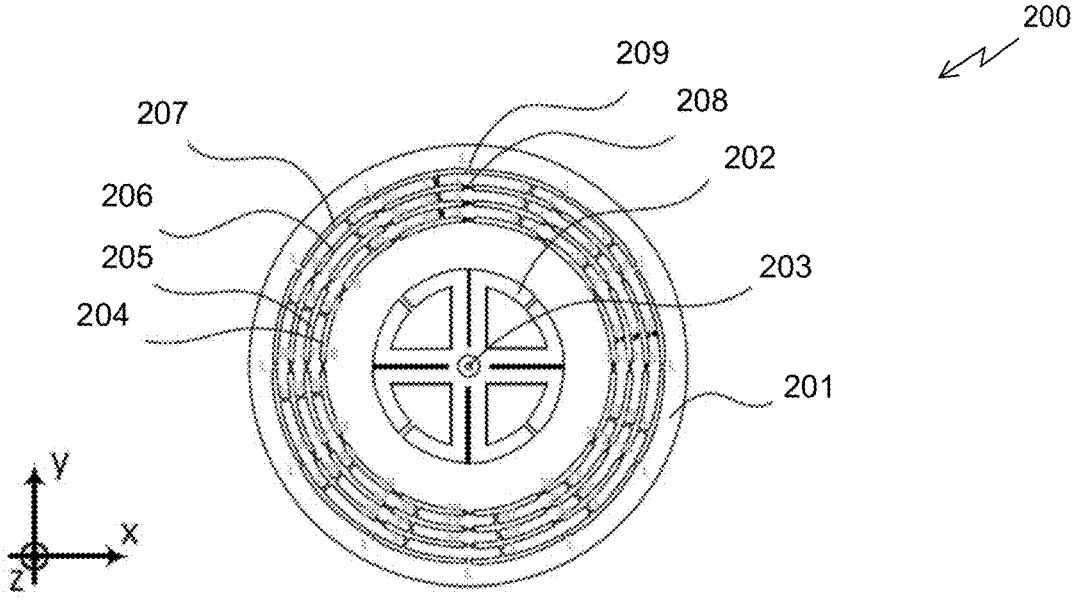
FIGS. 2A-2B illustrate a top view and a bottom view of the endfire beam-steerable horizontally polarized planar antenna, in accordance with some embodiments.
Figure 2B:
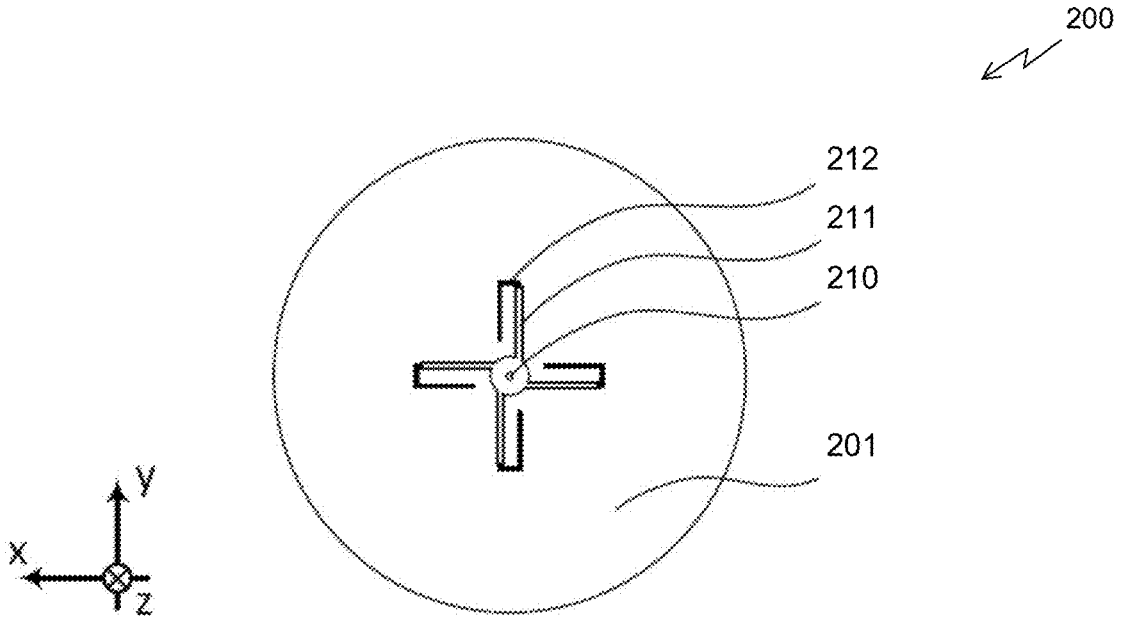

FIGS. 2A-2B illustrate a top view and a bottom view of an endfire beam-steerable horizontally polarized planar antenna 200, in accordance with some embodiments. A top view of the antenna 200 is depicted in FIG. 2A, and a bottom view of the antenna 200 is depicted in FIG. 2B. As shown in FIG. 2A, four rotationally symmetric radiating dipole arms 202 are printed at the center of a substrate 201. In an embodiment, the substrate 201 is a circular FR-4 board with a diameter of 82 mm. The dipole arms 202 can be printed via a photolithographic process. In an embodiment, the permittivity and thickness of the substrate 201 are 2.2 and 1.575 mm, respectively.

An interface 203 (e.g., an SMA connector) is soldered to the center of the dipole arms 202 as an interface to other RF devices. Parasitic elements 204-207, taking the form of four concentric rings of metal segments, are printed outside the dipole arms 202. In other embodiments, the parasitic elements 204-207 can be implemented as other shapes and do not have to be arranged concentrically.

The inner three rings of parasitic elements 204-206 can be configured as directors or reflectors based on the states of connections in the gaps 208 between the parasitic elements. The particular configuration of the connections is used to direct radiation at different angles in the azimuth plane. In some embodiments, the connections are made via fixed interconnects (e.g., metal wires). In other embodiments, the connections are made via switching elements such as a micro-electromechanical system (MEMS) device, PIN diodes, or field effect transistors (FETs). The outer ring of parasitic elements 207 is reserved for a direct current (DC) ground connection when switching elements are used to make connections in the inner three rings, and the connections in the gaps of the outer ring of parasitic elements include an inductor.

As shown in FIG. 2B, four baluns with two sections 211 and 212 are printed on the backside of the substrate 201. Section 211 may be a different width compared to section 212, said widths being selected for impedance matching. The core of the interface 210 is soldered to the four baluns such that an unbalanced signal can be converted into a balanced signal for exciting the dipole arms 202 on the front of the substrate 201.

FIG. 3A depicts a table 300 indicating a configuration of switches of the endfire beam-steerable horizontally polarized planar antenna 200 corresponding to a beam direction of zero degrees ($\Phi=0°$), in accordance with some embodiments. There are 60 numbered switches which each represent one of the connections between adjacent parasitic elements in the three inner rings of parasitic elements 204-206. It will be appreciated that the connections are both between parasitic elements in the same ring as well as between adjacent parasitic elements between the first and second ring as well as between the second and third ring. Connections between parasitic elements of the outer ring 207 as well as between parasitic elements of the third and fourth ring are hardwired and include an inductor. It will be appreciated that there are 12 parasitic elements per ring, meaning there are 36 connections between parasitic elements of the same ring and 24 connections between parasitic elements of the different rings. Connection numbers 1, 2, and 3 are located at 0 degrees relative to due North, if North corresponds to the top of the sheet for FIG. 2A, where connection 1 is associated with the third ring 206 located at gap 208 in FIG. 2A, connection 2 is associated with the second ring 205 directly below gap 208, and connection 3 is associated with the first ring 204 directly below gap 208. Connections 4 and 5 correspond to the connection between the parasitic elements in the third ring 206 and second ring 205 between approximately 0 and 30 degrees East of due North and the connection between the parasitic elements in the second ring 205 and the first ring 204 between approximately 0 and 30 degrees East of due North, respectively. Connections 6-60 continue around the rings in a clockwise manner alternating between the three connections between parasitic elements of the same rings and the two connections between parasitic elements of different rings.

The configuration of each connection is listed as closed ('yes' or 'no'), where a closed connection (i.e., 'yes') refers to a switch that is in a closed state and has low impedance to enable charge to be conducted between the two parasitic elements and an open connection (i.e., 'no') refers to a switch that is in an open state and has high impedance or does not permit charge to be conducted between the two parasitic elements. All 60 connections in the gaps between the inner three rings of parasitic elements 204-206 are listed in table 300. It will be appreciated that this configuration is optimized via electromagnetic simulation in accordance with a 0 degree azimuth angle. By changing the states of the 60 connections, the radiation beam can be steered in accordance with different angles in the azimuth plane.

FIG. 3B depicts a table 310 indicating a configuration of switches of the endfire beam-steerable horizontally polarized planar antenna 200 corresponding to a beam direction of thirty degrees ($\Phi=30°$), in accordance with some embodiments. FIG. 3C depicts a table 320 indicating a configuration of switches of the endfire beam-steerable horizontally polarized planar antenna 200 corresponding to a beam direction of sixty degrees ($\Phi=60°$), in accordance with some embodiments. It will be appreciated that due to the rotational symmetry of the arrangement of parasitic elements 204-207, the switch configurations are similar, except shifted by an amount corresponding to the desired angle.

Figure 4:
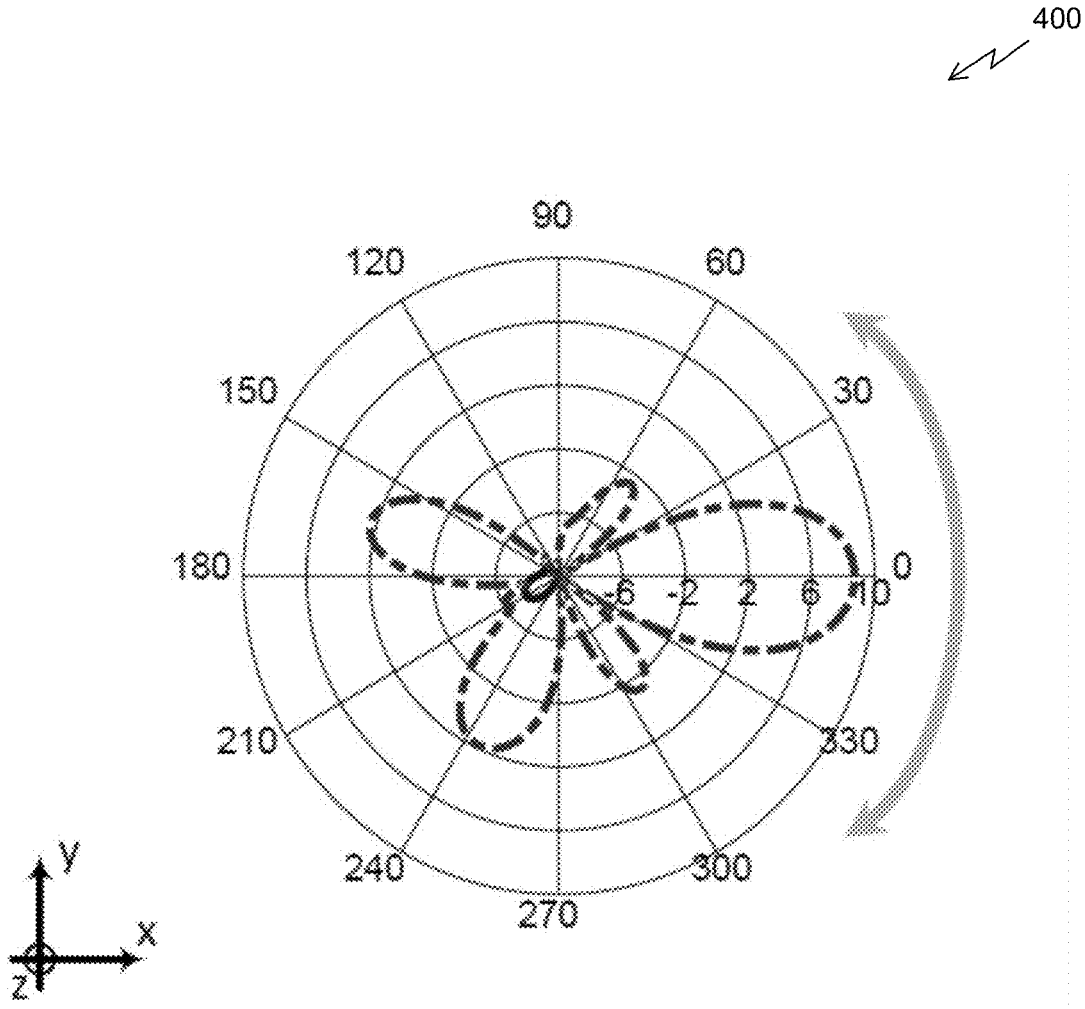
FIG. 4 depicts a graph of a simulated far-field radiation pattern of the endfire beam-steerable horizontally polarized planar antenna corresponding to the beam direction of zero degrees ($\Phi=0°$), in accordance with some embodiments.

FIG. 4 depicts a graph 400 of a simulated far-field radiation pattern of the endfire beam-steerable horizontally polarized planar antenna 200 corresponding to the beam direction of zero degrees ($\theta=0°$), in accordance with some embodiments. The dashed line and the solid line correspond to E-phi and E-theta radiations, respectively. It will be appreciated that the antenna 200 produces horizontally polarized radiation. Furthermore, the radiation beam is pointing to the positive x axis because the gap configurations have been optimized to the direction of $\Phi=0°$.

Figure 5:
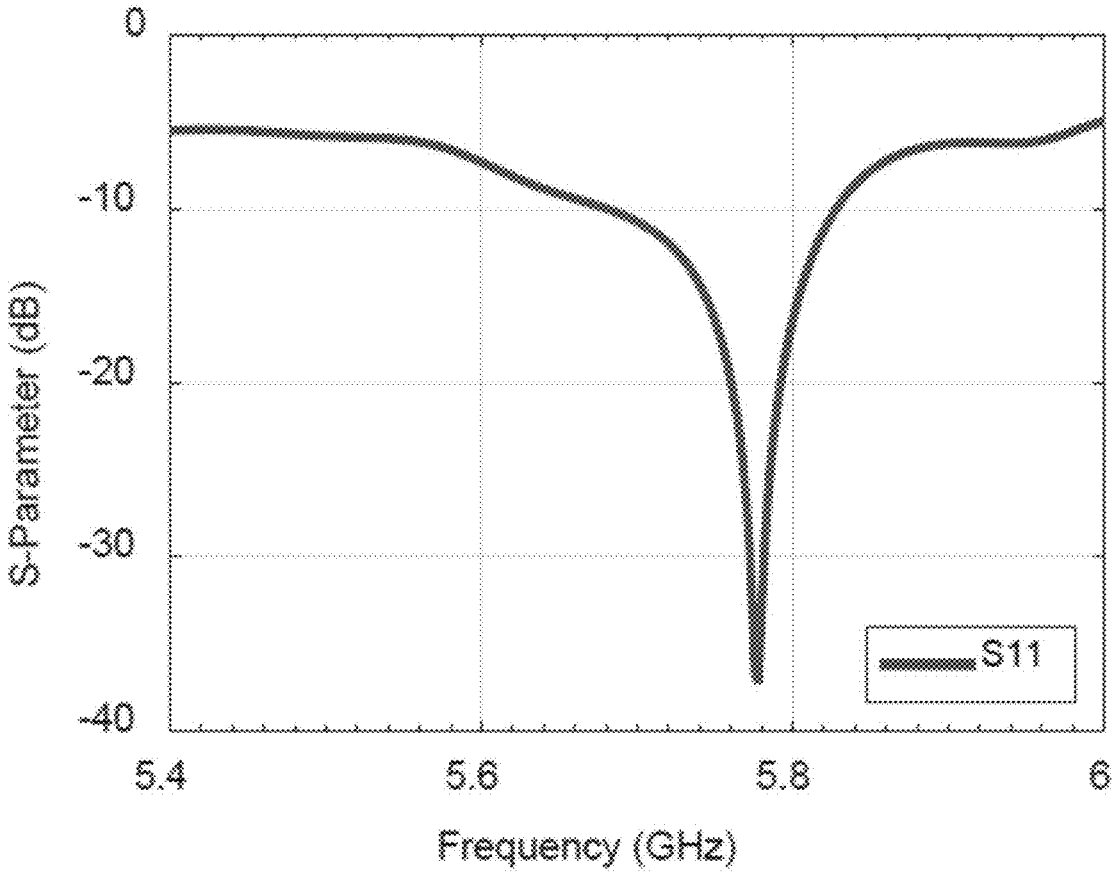
FIG. 5 depicts a graph of a simulated frequency response of the endfire beam-steerable horizontally polarized planar antenna corresponding to the beam direction of zero degrees ($\Phi=0°$), in accordance with some embodiments.

FIG. 5 depicts a graph 500 of a simulated frequency response of the endfire beam-steerable horizontally polarized planar antenna 200 corresponding to the beam direction of zero degrees ($\Phi=0°$), in accordance with some embodiments. As shown in the graph 500, the antenna 200 exhibits low power reflection to the antenna port in the frequency band of 5.8 GHz, which indicates that the antenna 200 is resonating within that frequency range.

Figure 6A:
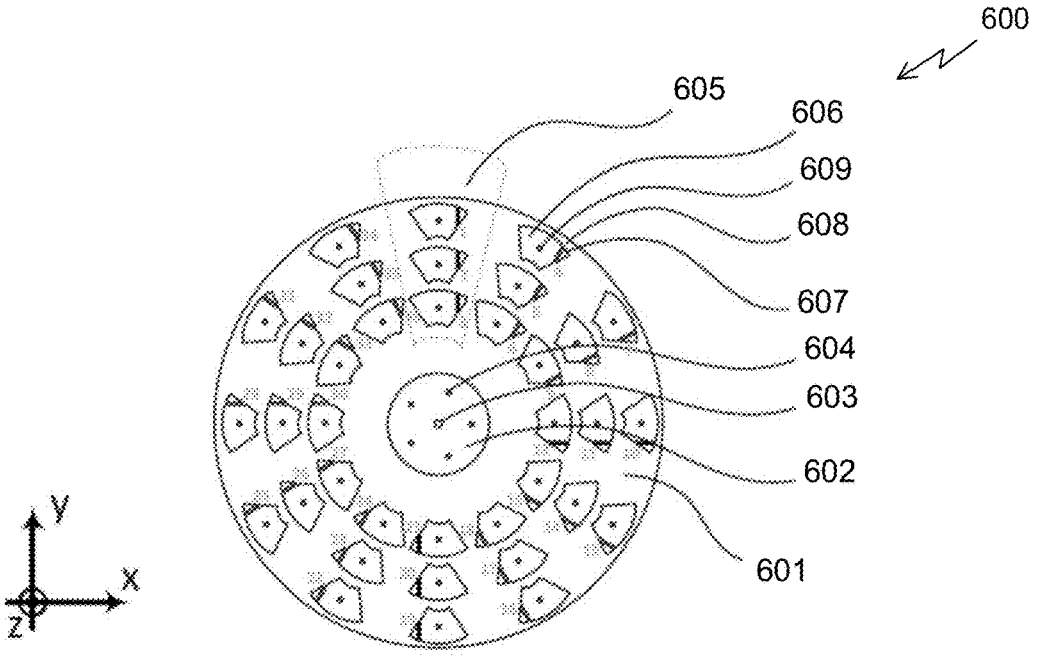
FIGS. 6A-6B illustrate top and bottom views of an endfire beam-steerable vertically polarized planar antenna, in accordance with some embodiments.
Figure 6B:
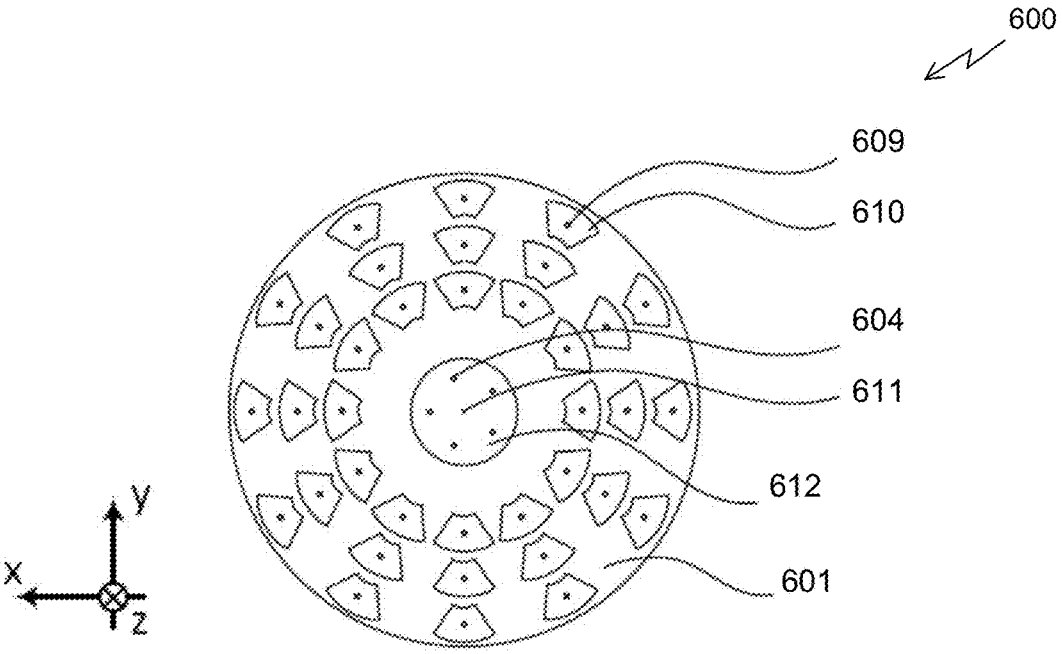

FIGS. 6A-6B illustrate top and bottom views of an endfire beam-steerable vertically polarized planar antenna 600, in accordance with some embodiments. A top view of the antenna 600 is depicted in FIG. 6A, and a bottom view of the antenna 600 is depicted in FIG. 6B. As shown in FIG. 6A, a circular monopole disc 602 (i.e., a radiating element) is printed at the center of a substrate 601. In an embodiment, the substrate 601 is a circular FR4 board with a diameter of 104 mm. The monopole disc 602 can be printed via a photolithographic process. In an embodiment, the permittivity and thickness of the substrate 601 are 2.42 and 1.5 mm, respectively.

An interface 603 (e.g., an SMA connector) is soldered to the center of the monopole disc 602 as an interface to other RF devices. Five shorting pins 604 (e.g., vias) are distributed on the monopole disc 602 for connecting the top and bottom sides of the substrate 601. The shorting pins 604 can be, e.g., drilled holes in the board that are subsequently filled with solder or otherwise plated with a conductive material (e.g., copper). In an embodiment, the shorting pins 604 may be evenly distributed (i.e., radially symmetric) around a central axis of the monopole disc 602. Parasitic elements 605, taking the form of three concentric rings of metal segments, are printed outside the monopole disc 602. In other embodiments, the parasitic elements 605 can be implemented as other shapes and do not have to be arranged concentrically.

Each metal segment includes two parts: a first portion 606 and a second portion 607, separated by a gap 608. The shape and area of the first portion 606 and second portion 607 can be different. The metal segments can act as directors or reflectors based on the state of connections in the gaps 608 between the first portions 606 and corresponding second portions 607. The particular configuration of the connections is used to direct radiation at different angles in the azimuth plane. In some embodiments, the connections are made via fixed interconnects (e.g., metal wires). In other embodiments, the connections are made via switching elements such as micro-electromechanical system (MEMS) or PIN diodes. In an embodiment, a shorting pin 609 is inserted into the first portion 606 of each metal segment to connect the first portion 606 with a corresponding metal segment (e.g., unified metal segment 610) on the bottom side of the substrate 601. The shorting pins 609 can be similar in structure to the shorting pins 604.

As shown in FIG. 6B, a separate monopole disc 612 is printed at the center of the substrate 601, which is connected to the monopole disc 602 via the shorting pins 604. An interface 611 (e.g., an SMA connector) is soldered to the monopole disc 612.

FIG. 7A depicts a table 700 indicating a configuration of switches of the endfire beam-steerable vertically polarized planar antenna 600 corresponding to a beam direction of zero degrees (Φ=0°), in accordance with some embodiments. There are 36 numbered switches which each represent one of the connections in the gaps 608 between corresponding first portions 606 and second portions 607 of the metal segments. It will be appreciated that there are 12 parasitic elements per ring. Connection numbers 1, 2, and 3 are located at 0 degrees relative to due North, if North corresponds to the top of the sheet for FIG. 6A, where connection 1 is associated with the outer ring, connection 2 is associated with the middle ring, and connection 3 is associated with the inner ring. Connections 4, 5, and 6 correspond to the connection between the first portions 606 and the second portions 607 for the parasitic elements located at approximately 30 degrees east of due North, in ascending order from the outer ring to the inner ring, respectively. Connections 6-36 continue around the rings in a clockwise manner.

The configuration of each connection is listed as closed ('yes' or 'no'), where a closed connection (i.e., 'yes') refers to a switch that is in a closed state and has low impedance to enable charge to be conducted between the portions 606 and 607 of the parasitic elements and an open connection (i.e., 'no') refers to a switch that is in an open state and has high impedance or does not permit charge to be conducted between the two portions of the parasitic elements. All 36 connections in the gaps between the portions of parasitic elements are listed in table 700. It will be appreciated that this configuration is optimized via electromagnetic simulation in accordance with a 0 degree azimuth angle. By changing the states of the 36 connections, the radiation beam can be steered in accordance with different angles in the azimuth plane.

FIG. 7B depicts a table 710 indicating a configuration of switches of the endfire beam-steerable vertically polarized planar antenna 600 corresponding to a beam direction of thirty degrees (Φ=30°), in accordance with some embodiments. FIG. 7C depicts a table 720 indicating a configuration of switches of the endfire beam-steerable vertically polarized planar antenna 600 corresponding to a beam direction of sixty degrees (Φ=60°), in accordance with some embodiments.

Figure 8:
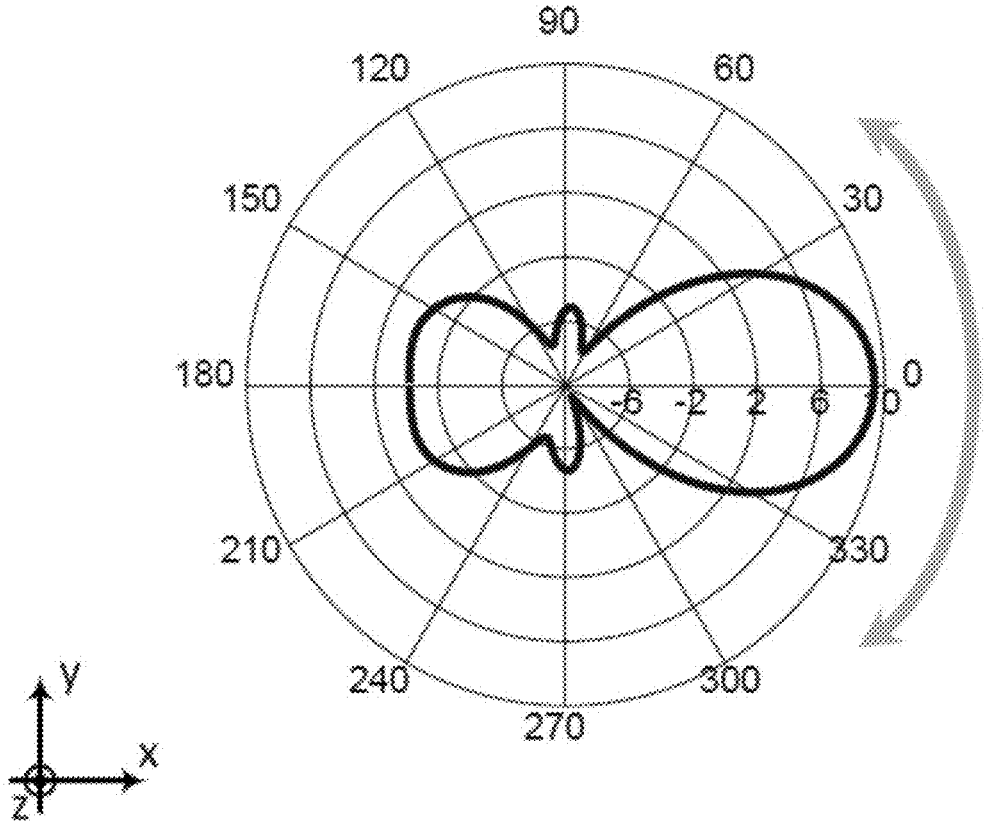
FIG. 8 depicts a graph of a simulated far-field radiation pattern of the endfire beam-steerable vertically polarized planar antenna corresponding to the beam direction of zero degrees (Φ=0°), in accordance with some embodiments.

FIG. 8 depicts a graph 800 of a simulated far-field radiation pattern of the endfire beam-steerable vertically polarized planar antenna 600 corresponding to the beam direction of zero degrees (Φ=0°), in accordance with some embodiments. The dashed line and the solid line correspond to E-phi and E-theta radiations, respectively. It will be appreciated that the antenna 600 produces vertically polarized radiation. Furthermore, the radiation beam is pointing to the positive x axis because the gap configurations have been optimized to the direction of Φ=0°.

Figure 9:
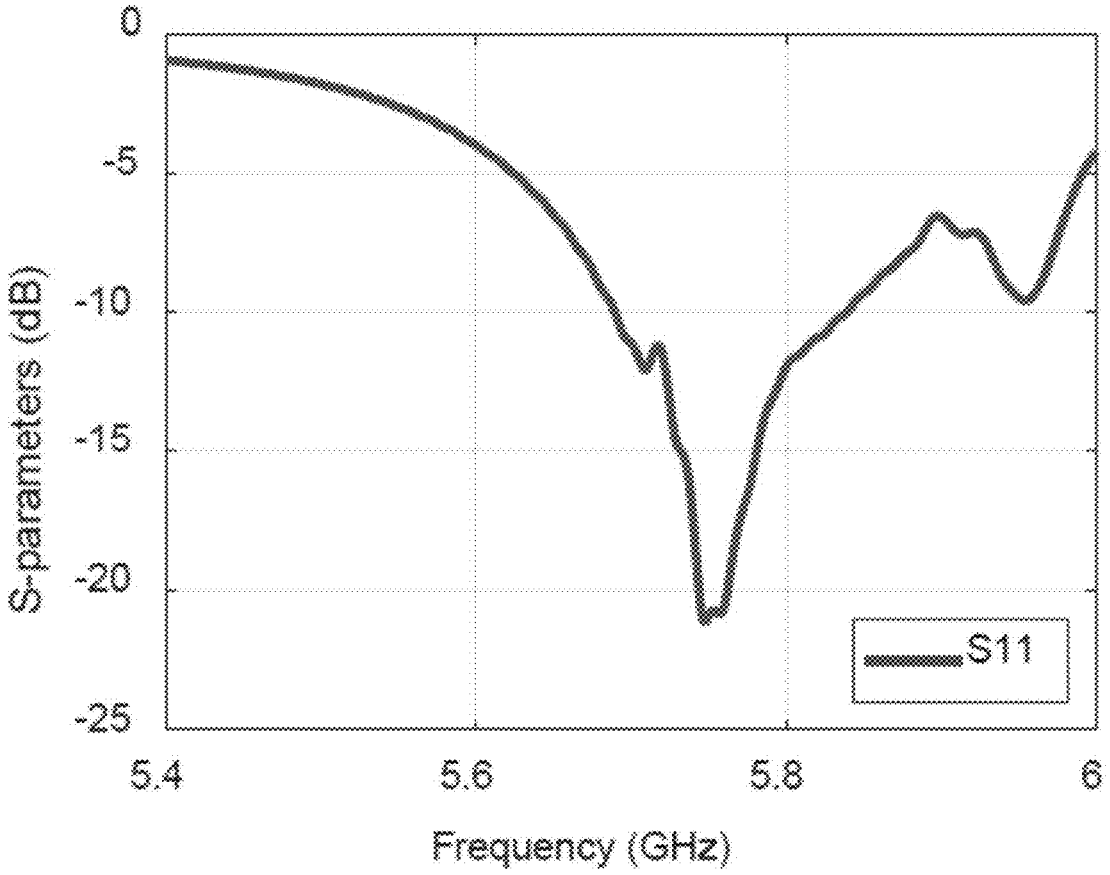
FIG. 9 depicts a graph of a simulated frequency response of the endfire beam-steerable vertically polarized planar antenna corresponding to the beam direction of zero degrees (Φ=0°), in accordance with some embodiments.

FIG. 9 depicts a graph 900 of a simulated frequency response of the endfire beam-steerable vertically polarized planar antenna corresponding to the beam direction of zero degrees (Φ=0°), in accordance with some embodiments. As shown in the graph 900, the antenna 600 exhibits low power reflection to the antenna port in the frequency band of 5.8 GHz, which indicates that the antenna 200 is resonating within that frequency range.

Figure 10:
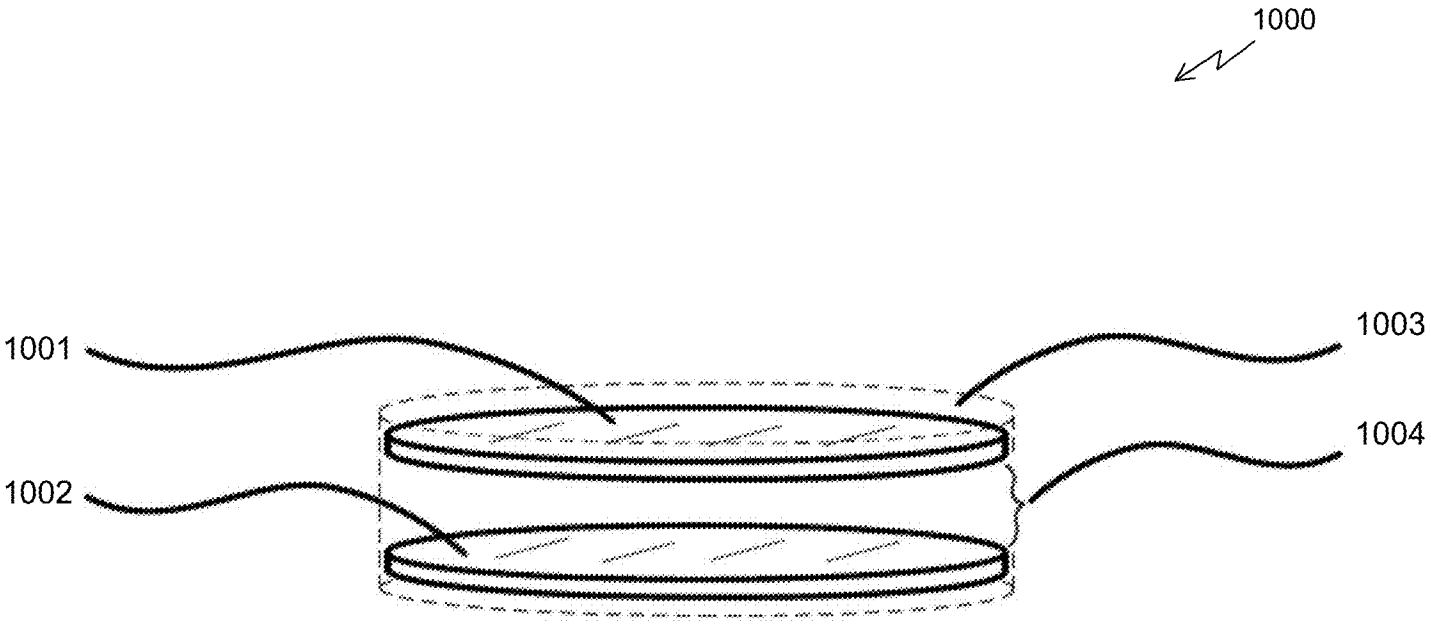
FIG. 10 illustrates a dual-port, dual-polarized endfire beam-steerable planar antenna, in accordance with some embodiments.

FIG. 10 illustrates a dual-port, dual-polarized endfire beam-steerable planar antenna system 1000, in accordance with some embodiments. The system 1000 includes two antenna elements 1001 and 1002, which refer to antenna 200 (horizontally polarized) and antenna 600 (vertically polarized), respectively, or vice versa. The antenna system 1000 can be installed in a low-profile case 1003 of, for example, an access point or router, which may be commonly mounted on a ceiling of a room. The associated circuitry and battery (e.g., power source) can be accommodated within a region 1004 between the two antenna elements 1001 and 1002, which are separated by a distance sufficient to accommodate circuitry therein.

In one embodiment, the circuitry includes a controller disposed in region 1004 and configured to generate DC signals for each of the switching elements. The controller may be configured to determine a direction associated with a particular channel to transmit a signal and look up a configuration of switching elements associated with that direction in a look up table. The configuration can be used to generate a plurality of DC signals that control the states of the switching elements in order to steer the beam of radiation generated from each of the antenna elements 1001 and 1002 in optimal directions.

Figure 11A:
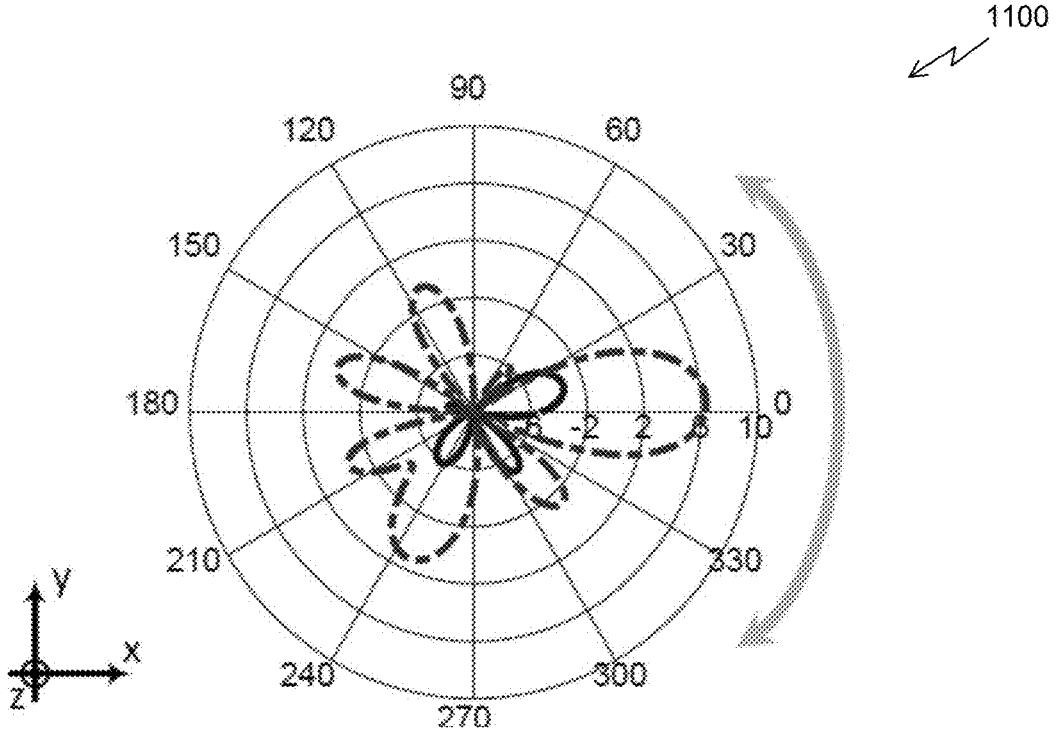
FIG. 11A-11B depicts a graph of simulated far-field radiation patterns of the dual-port, dual-polarized endfire beam-steerable planar antenna corresponding to the beam direction of zero degrees (Φ=0°), in accordance with some embodiments.

FIG. 11A depicts a graph 1100 of a simulated far-field radiation pattern of the dual-port, dual-polarized endfire beam-steerable planar antenna system 1000 from port 1 corresponding to the beam direction of zero degrees (Φ=0°), in accordance with some embodiments. Port 1 corresponds to a horizontally polarized antenna element such as antenna 200. In an embodiment, the separation between the antenna elements 1001 and 1002 is 20 mm. The dashed line and the solid line correspond to E-phi and E-theta radiations, respectively. It will be appreciated that the antenna 200 produces horizontally polarized radiation. Furthermore, the radiation beam is pointing to the positive x axis because the gap configurations have been optimized to the direction of Φ=0°.

Figure 11B:
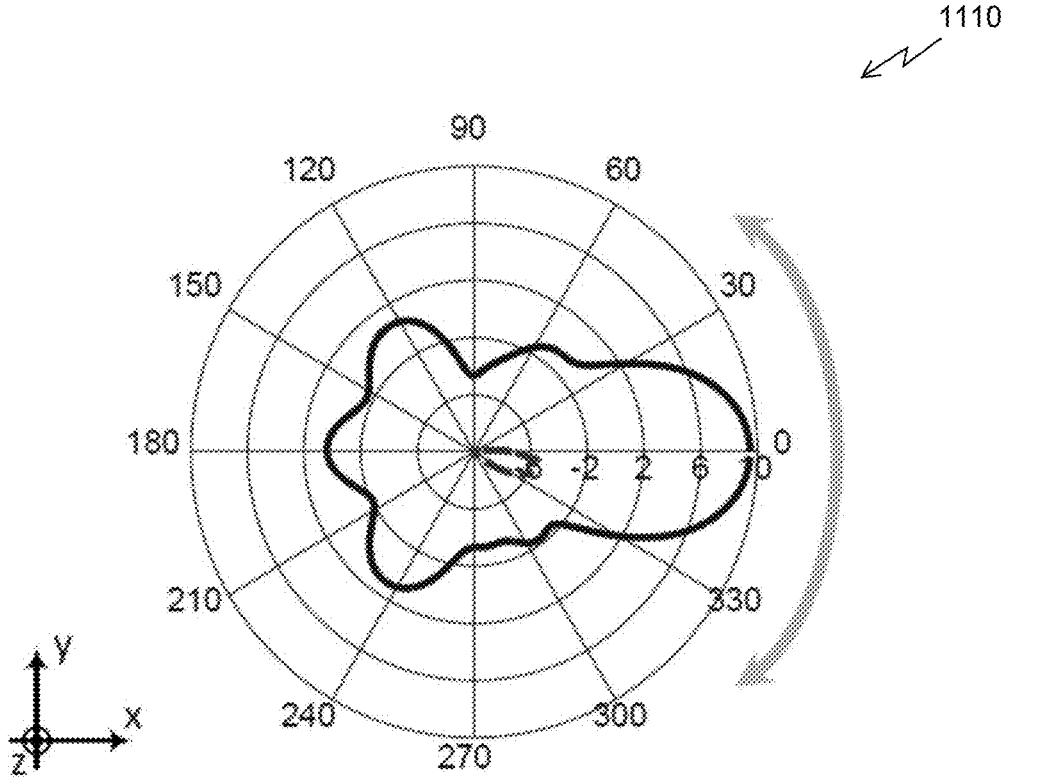

FIG. 11B depicts a graph 1110 of a simulated far-field radiation pattern of the dual-port, dual-polarized endfire beam-steerable planar antenna system 1000 from port 2 corresponding to the beam direction of zero degrees (Φ=0°), in accordance with some embodiments. Port 2 corresponds to a vertically polarized antenna element such as antenna 600. In an embodiment, the separation between the antenna elements 1001 and 1002 is 20 mm. The dashed line and the solid line correspond to E-phi and E-theta radiations, respectively. It will be appreciated that the antenna 600 produces vertically polarized radiation. Furthermore, the radiation beam is pointing to the positive x axis because the gap configurations have been optimized to the direction of Φ=0°.

Figure 12:
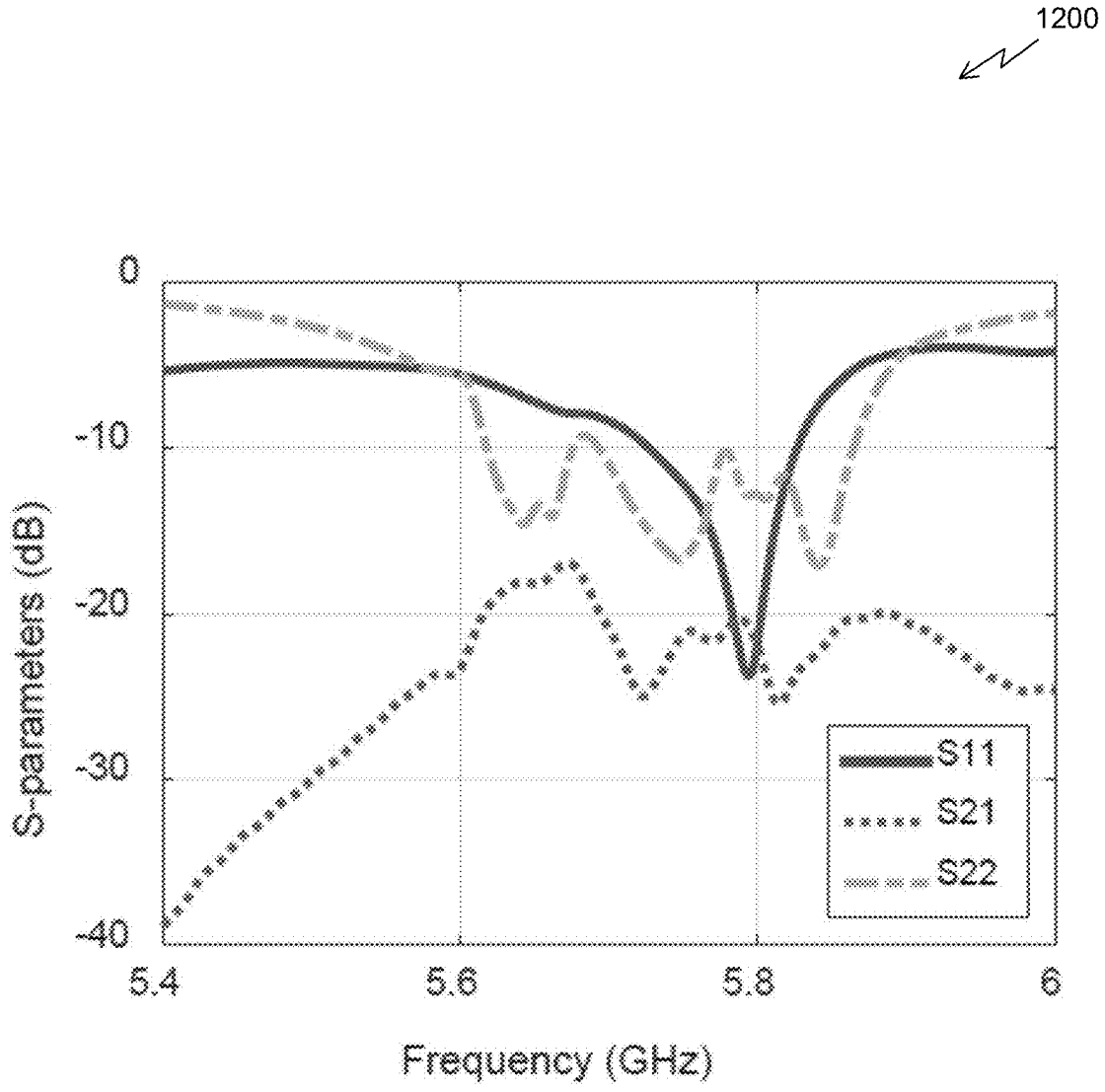
FIG. 12 depicts a graph of a simulated frequency response of the dual-port, dual-polarized endfire beam-steerable planar antenna corresponding to the beam direction of zero degrees (Φ=0°), in accordance with some embodiments.

FIG. 12 depicts a graph 1200 of a simulated frequency response of the dual-port, dual-polarized endfire beam-steerable planar antenna system 1000 corresponding to the beam direction of zero degrees (Φ=0°), in accordance with some embodiments. As shown in the graph 1200, the antenna system 1000 exhibits low power reflections to the antenna ports in the frequency band of 5.8 GHz, which indicates that the antenna system 1000 is resonating within that frequency range. The mutual coupling between the two antenna elements is low due to the orthogonality of the polarization of each antenna element.

Figure 13:
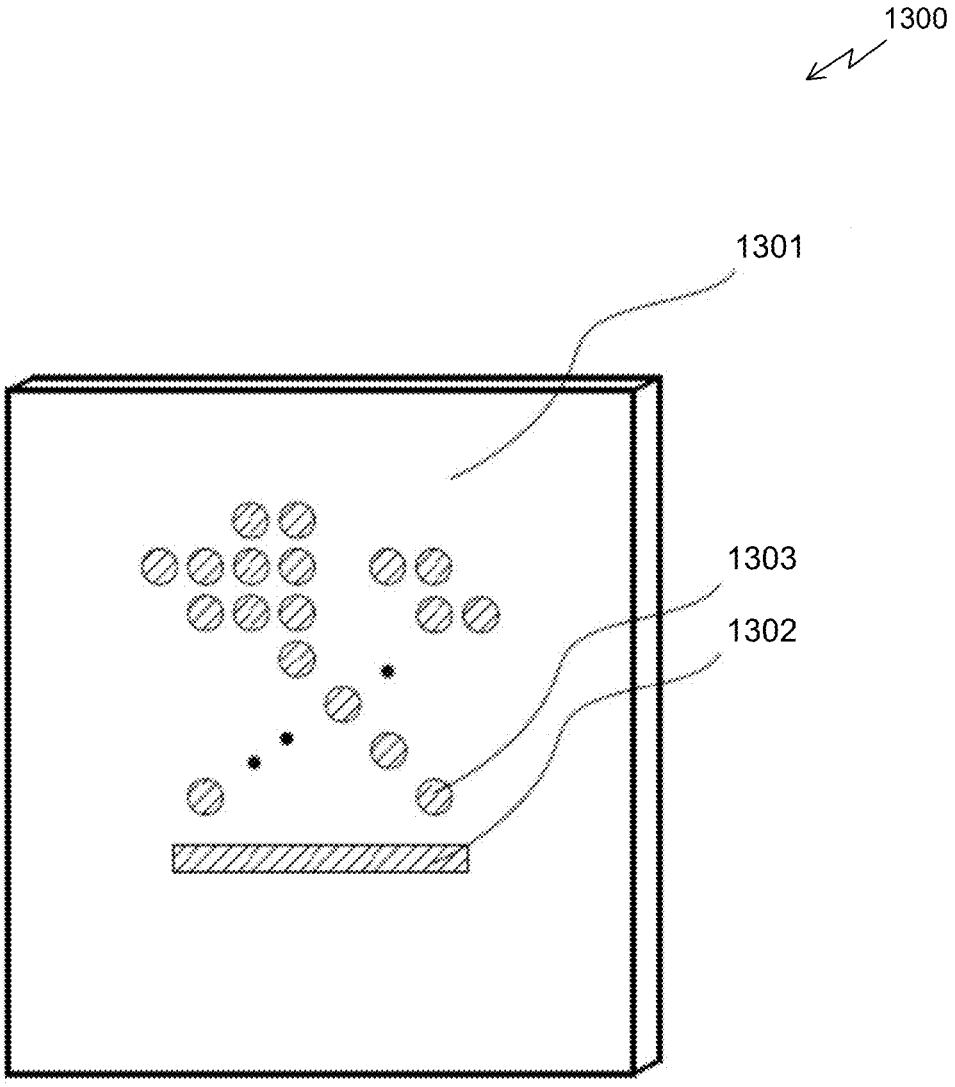
FIG. 13 illustrates a single port reconfigurable planar antenna, in accordance with some embodiments.

FIG. 13 illustrates a single port reconfigurable planar antenna 1300, in accordance with some embodiments. The antenna 1300 includes a driven element 1302 and a grid of parasitic elements 1303. Both the driven element 1302 and the parasitic elements 1303 are made of a metallic material (e.g., copper) and are printed on a substrate 1301 (e.g., FR4 PCB). The driven element 1302 is excited through an interface (e.g., an SMA connector), which is connected to an external RF circuitry. A signal from the RF circuitry causes the driven element 1302 to generate radiation in an RF band.

The grid of parasitic elements 1303 include an array of small metal areas on the surface of the substrate 1301, which can be referred to as pixels. The number and shape of the pixels are not limited to the arrangement shown in FIG. 13, but in exemplary embodiments, a dimension of the pixel may be approximately 0.1 of the wavelength of the resonant frequency. For a resonant frequency of 5.8 GHz, the pixel dimension would be approximately 5 mm.

All pixels are isolated without directly touching neighboring pixels, but any two adjacent pairs of pixels may be connected by a switching element such as the MEMS device, PIN diode, or a field effect transistor (FET). When the switching element is in an 'on' state, the switching element allows charge to be conducted across the gap between corresponding pixels. Otherwise, when the switching element is in an 'off' state, the corresponding pixels are electrically isolated. By varying the state of all connections interspersed between the pixels, the direction of the beam formed by the antenna 1300 can be controlled.

Figure 14A:
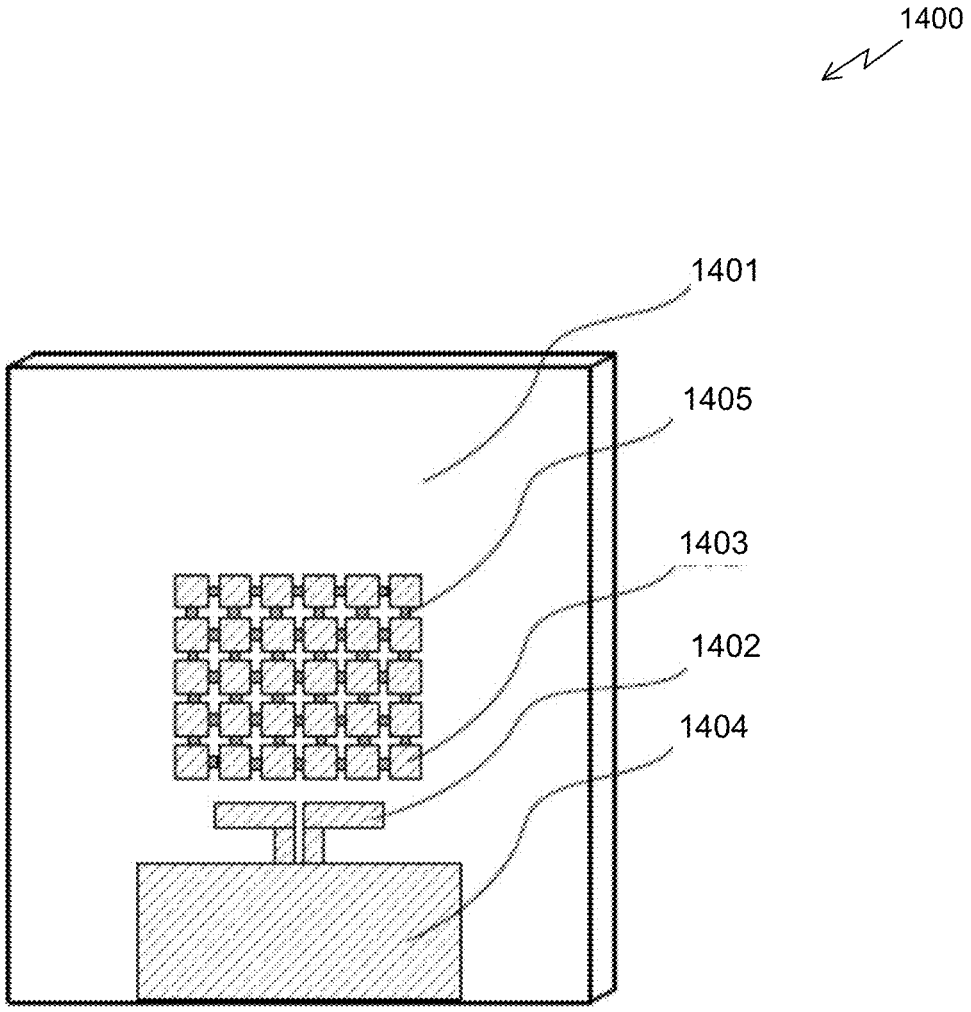
FIG. 14A-14B illustrate top and bottom views of a single port reconfigurable planar antenna, in accordance with some embodiments.
Figure 14B:
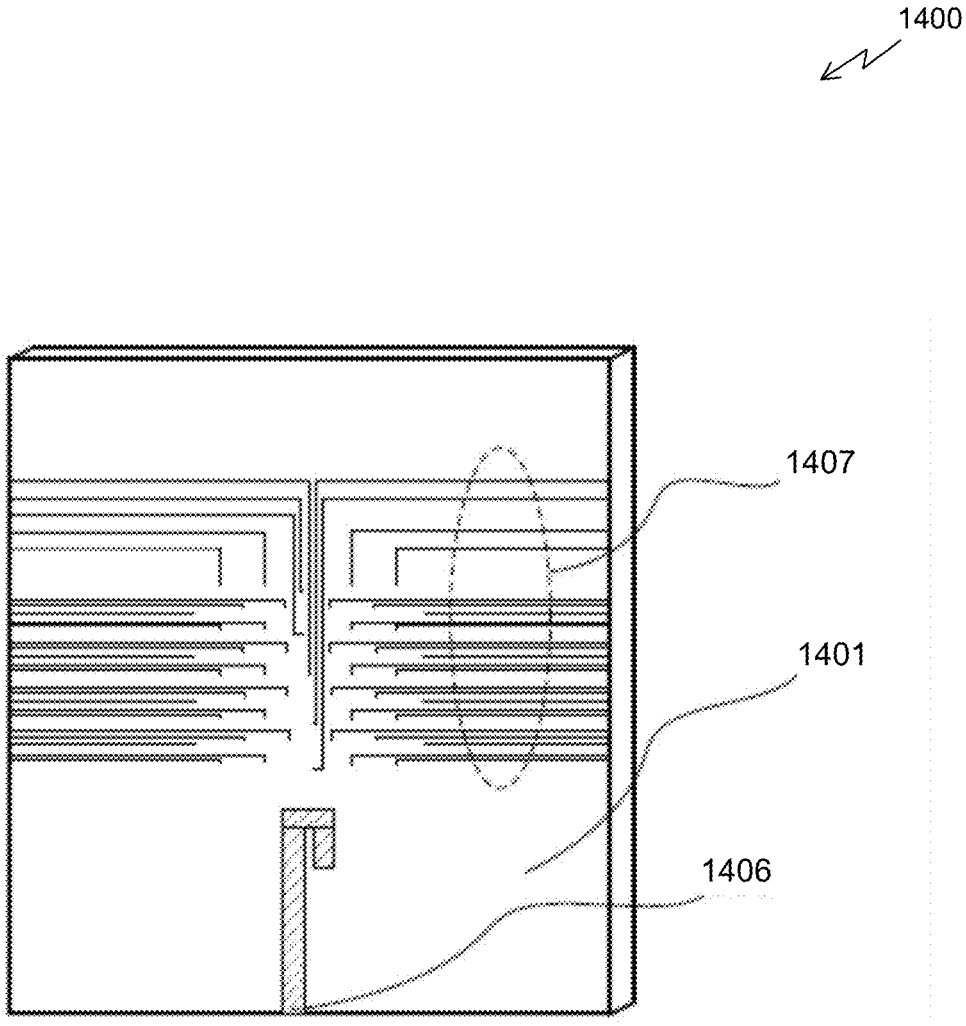

FIG. 14A-14B illustrate a top view and a bottom view of a single port reconfigurable planar antenna 1400, in accordance with some embodiments. A top view of the antenna 1400 is depicted in FIG. 14A, and a bottom view of the antenna 1400 is depicted in FIG. 14B. As shown in FIG. 14A, the antenna 1400 includes a driven element 1402 is a dipole antenna printed on a top layer of the substrate 1401. In an embodiment, the substrate 1401 is a printed circuit board, which may be formed from one or more layers of FR4 as well as conducting layers such as a copper ground plane. The driven element 1402 is connected to the ground plane 1404, which is used to reflect the radiation generated by the driven element 1402 back towards a grid of parasitic elements 1403.

In an embodiment, the grid of parasitic elements 1403 includes thirty pixels arranged in five rows and six columns. Switching elements 1405 are used to connect adjacent parasitic elements 1403. Thus, a total of forty-nine switching elements 1405 or shown in the grid of parasitic elements 1403.

A bottom surface of the substrate 1401, as depicted in FIG. 14B, an open-ended stripline 1406 is printed directly under the driven element 1402 on the top surface of the substrate 1401. The open-ended stripline 1406 is fed on the edge of the substrate 1401 to excite the driven element 1402 on the top surface of the substrate 1401. The excitation is achieved via inductive coupling. All forty-nine switching elements 1405 can be individually controlled via DC interconnects 1407 routed on the bottom surface of the substrate 1401. In an embodiment, the DC interconnects 1407 can be broken down into short sections, with each adjacent section controlling a signal on the other section using lumped inductors. Breaking up the DC interconnects in this fashion can help minimize RF interference generated by relatively long DC interconnects. It will be appreciated that vias (i.e., shorting pins) may be formed in the substrate 1401 to connect the elements on the top surface and the bottom surface.

Figure 15A:
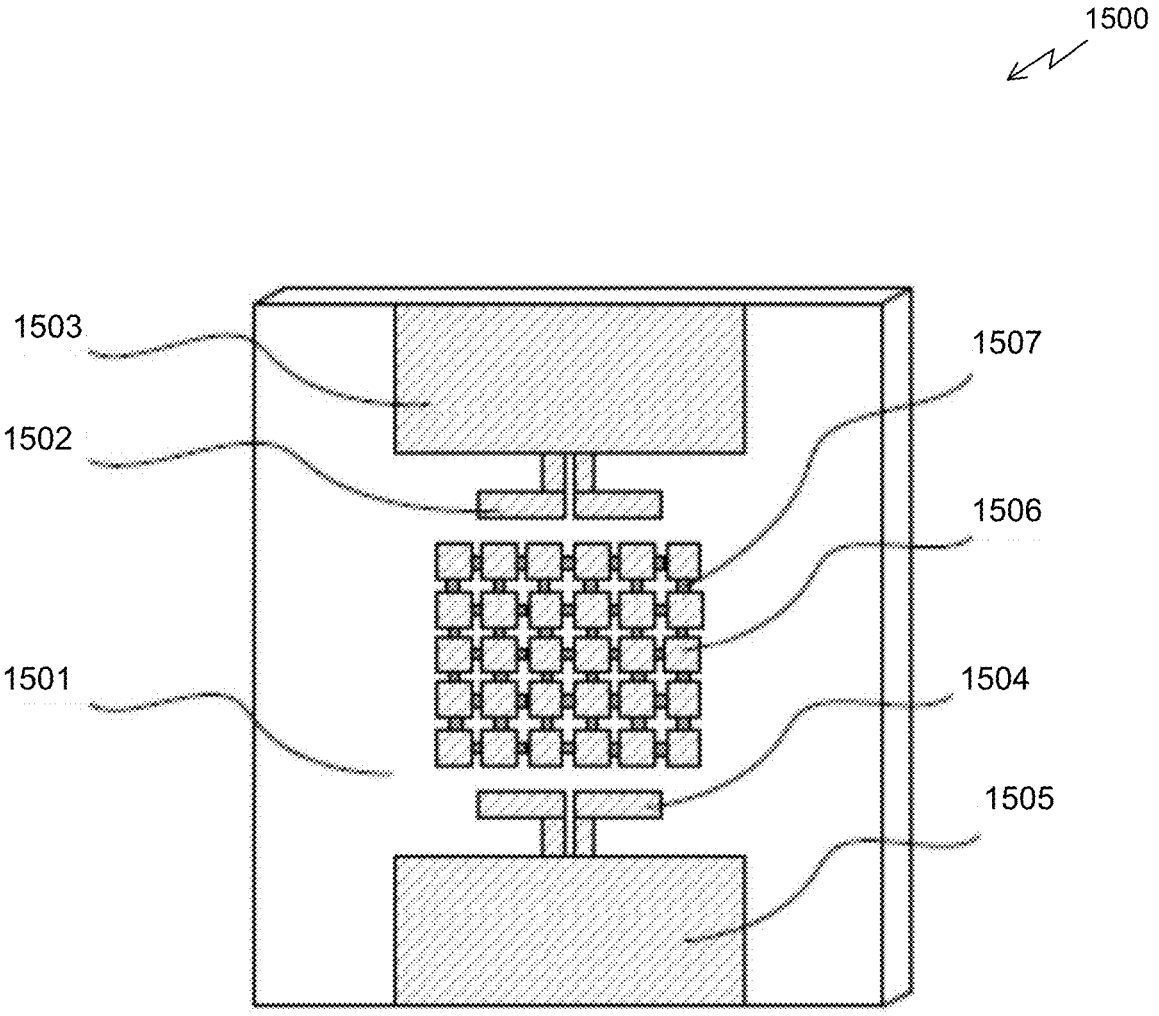
FIGS. 15A-15C illustrate three alternative arrangements of the dual-port reconfigurable planar antenna system, in accordance with some embodiments.
Figure 15B:
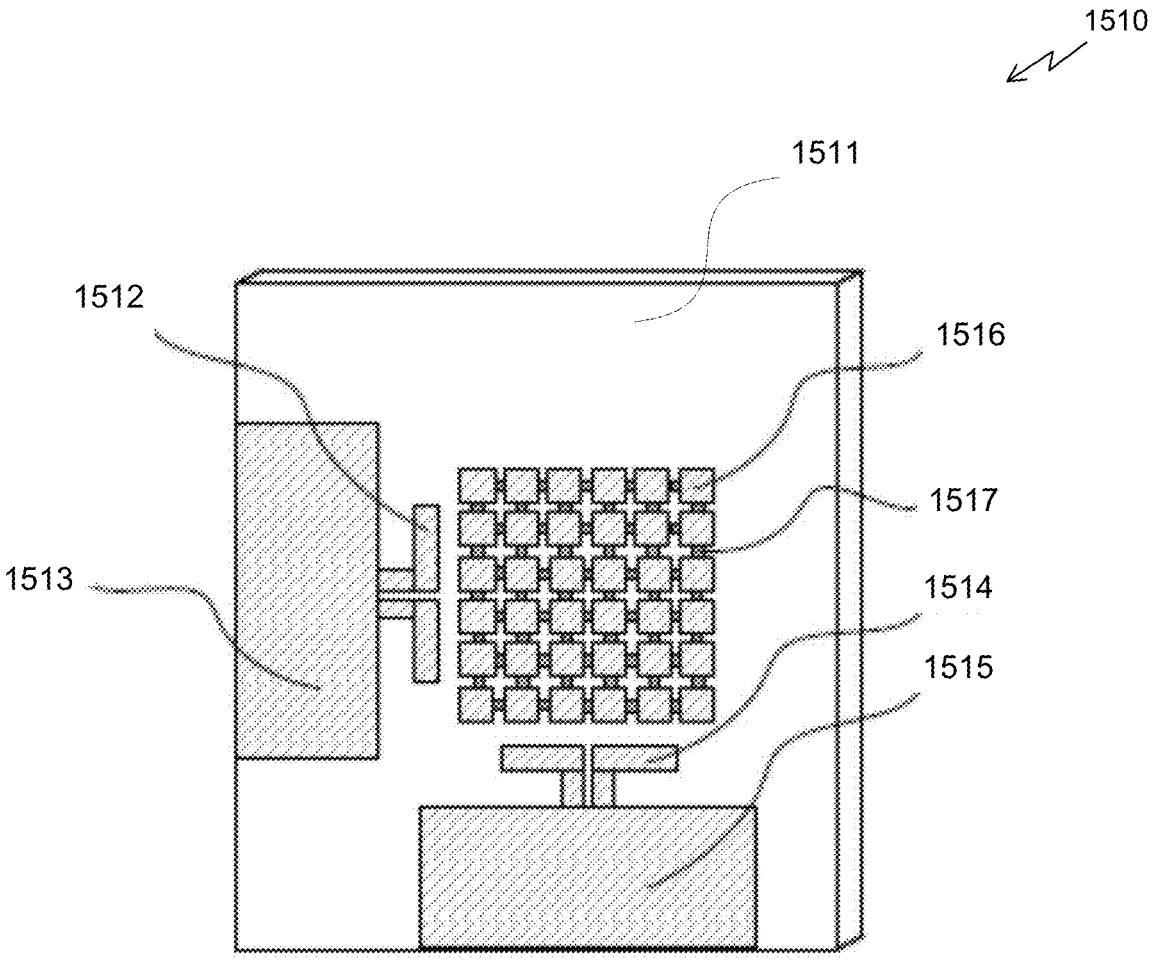
Figure 15C:
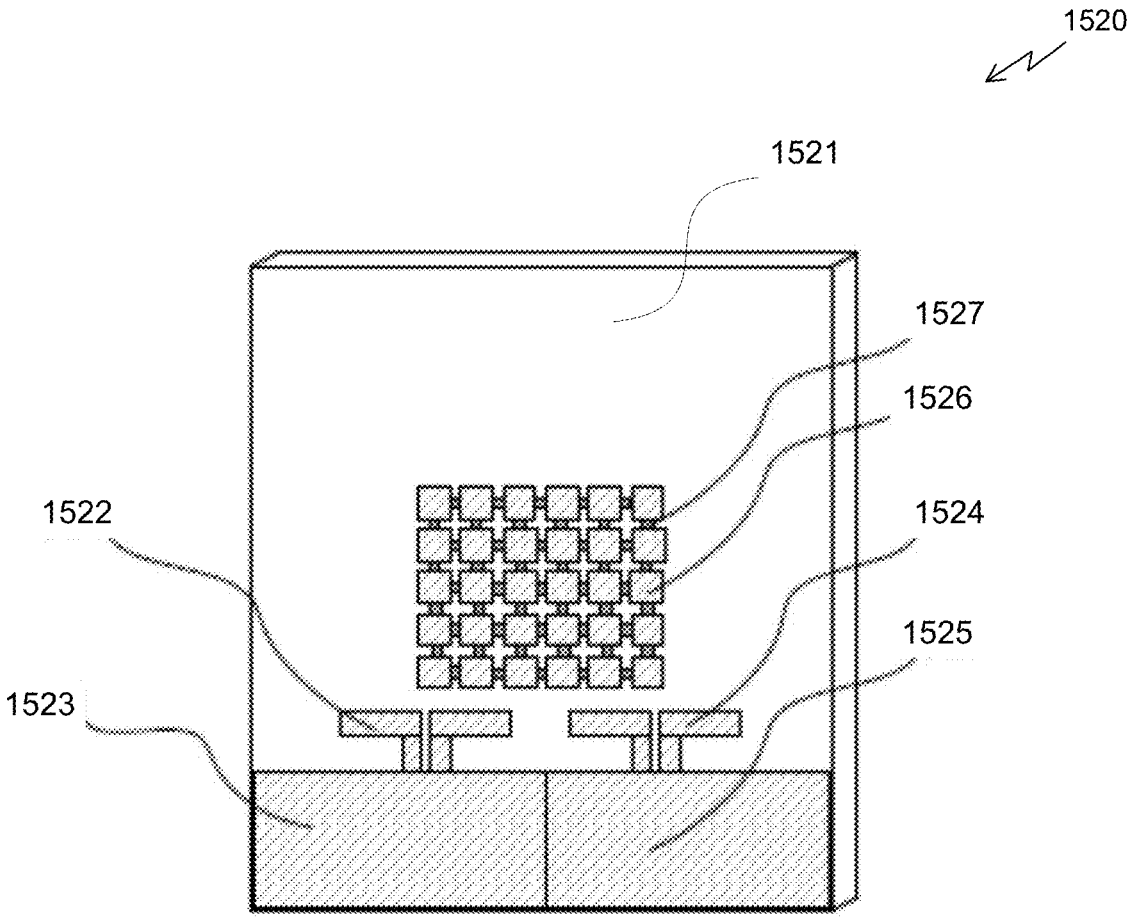

FIGS. 15A-15C illustrate three alternative arrangements of the dual-port reconfigurable planar antenna system 1500, in accordance with some embodiments. As depicted in FIG. 15A, the antenna system 1500 includes a pair of dipole antennas, with a first port corresponding to a first dipole antenna 1502 connected to a first ground plane 1503 and a second port corresponding to a second dipole antenna 1504 connected to a second ground plane 1505. In some embodiments, the ground planes 1503, 1505 consist of a single ground plane shared by the dipole antennas 1502, 1504. The two dipole antennas are on opposite sides of the grid of parasitic elements 1506 printed in a central region of the substrate 1501. Again, each pair of adjacent parasitic elements 1506 can be connected via a switching element 1507. The grid of parasitic elements 1506 is shared by the pair of dipole antennas 1502, 1504.

As depicted in FIG. 15B, the antenna system 1510 includes a pair of dipole antennas, with a first port corresponding to a first dipole antenna 1512 connected to a first ground plane 1513 and a second port corresponding to a second dipole antenna 1514 connected to a second ground plane 1515. In some embodiments, the ground planes 1513, 1515 consist of a single ground plane shared by the dipole antennas 1512, 1514. The two dipole antennas are located on adjacent sides of the grid of parasitic elements 1516 printed in a central region of the substrate 1511. Again, each pair of adjacent parasitic elements 1516 can be connected via a switching element 1517. The grid of parasitic elements 1516 is shared by the pair of dipole antennas 1512, 1514. It will be appreciated that, due to the symmetric geometry of the two dipole antennas 1512, 1514, it is recommended that the grid of parasitic elements 1516 should have a square form; i.e., should have an equal number of rows and columns and the shape of the pixels should also be square (i.e., have the same dimension in length and width).

As depicted in FIG. 15C, the antenna system 1520 includes a pair of dipole antennas, with a first port corresponding to a first dipole antenna 1522 connected to a first ground plane 1523 and a second port corresponding to a second dipole antenna 1524 connected to a second ground plane 1525. In some embodiments, the ground planes 1523, 1525 consist of a single ground plane shared by the dipole antennas 1522, 1524. The two dipole antennas are located on the same side of the grid of parasitic elements 1526 printed in a central region of the substrate 1521. Again, each pair of adjacent parasitic elements 1526 can be connected via a switching element 1527. The grid of parasitic elements 1526 is shared by the pair of dipole antennas 1522, 1524.

Figure 16A:
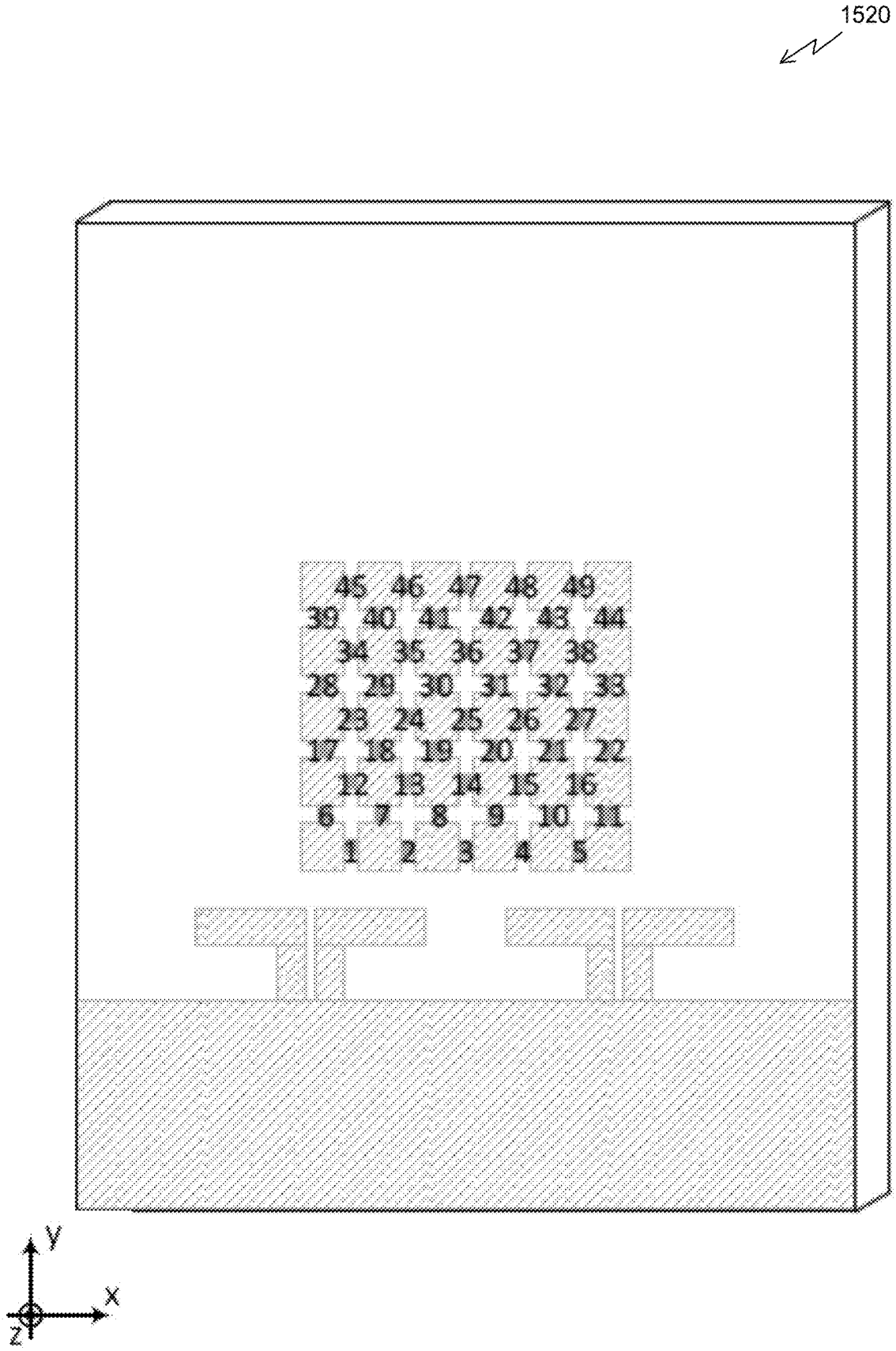
FIG. 16A shows the dual-port reconfigurable planar antenna system of FIG. 15C, in accordance with some embodiment.
Figure 17A:
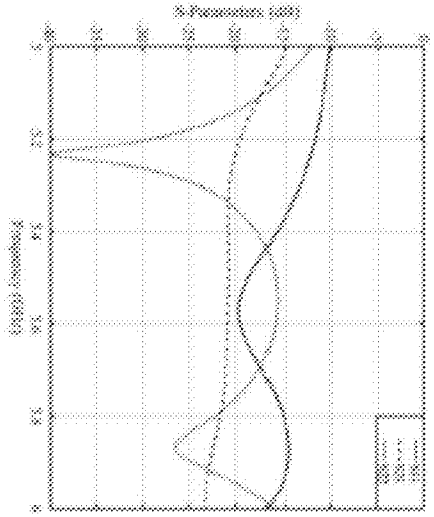
FIGS. 17A-17F depict graphs of a simulated frequency response of the antenna system corresponding to the beam direction of Φ=0°, 30°, 60°, 90°, 300°, and 330°, respectively, in accordance with some embodiments.
Figure 17B:
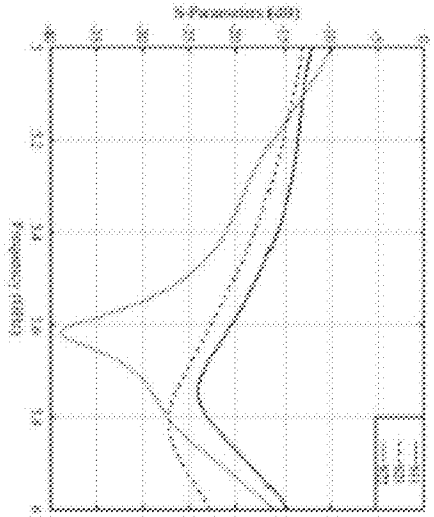
Figure 17C:
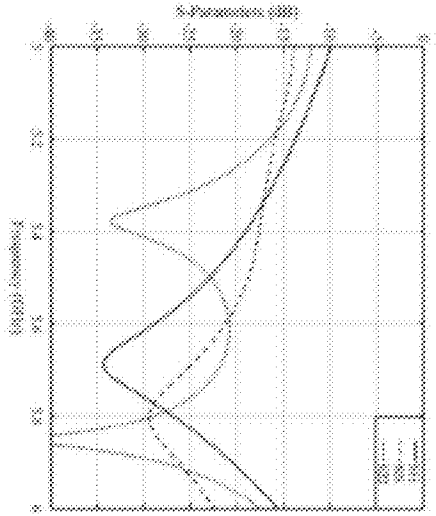
Figure 17D:
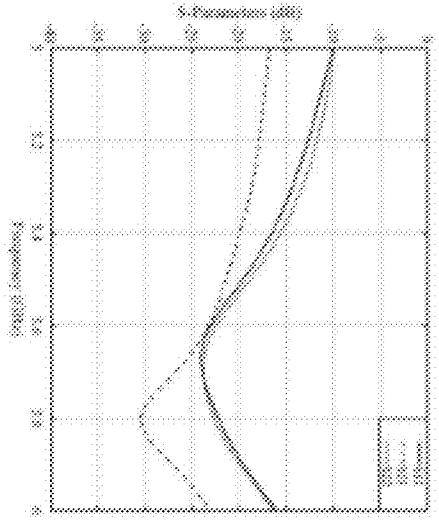
Figure 17E:
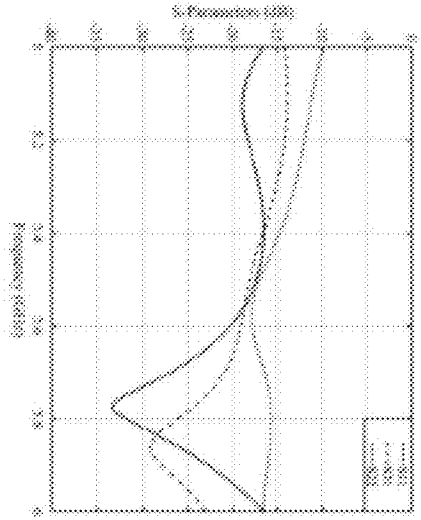
Figure 17F:
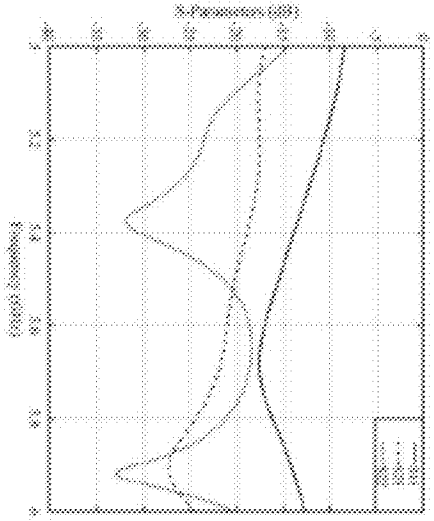
Figure 18A:
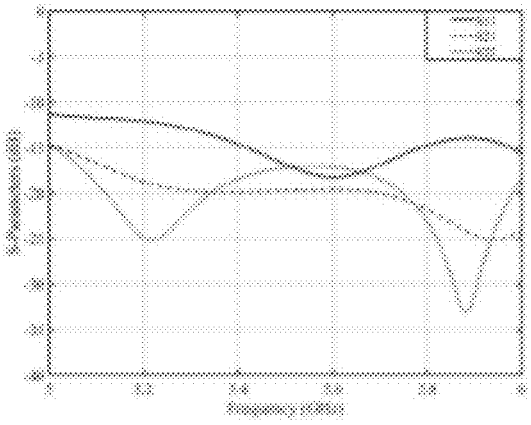
FIGS. 18A-18F depict graphs of a measured frequency response of the antenna system corresponding to the beam direction of Φ=0°, 30°, 60°, 90°, 300°, and 330°, respectively, in accordance with some embodiments.
Figure 18B:
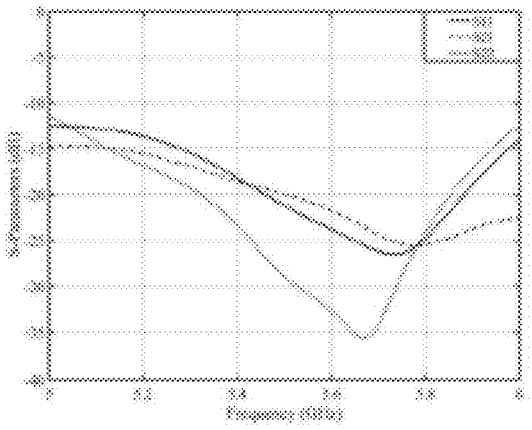
Figure 18C:
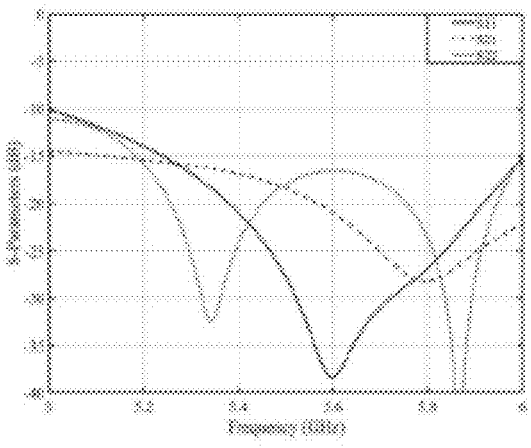
Figure 18D:
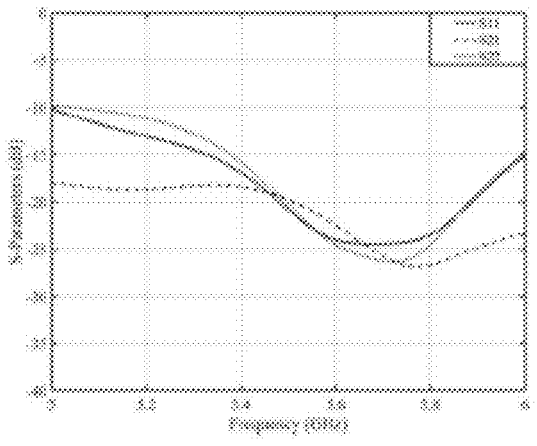
Figure 18E:
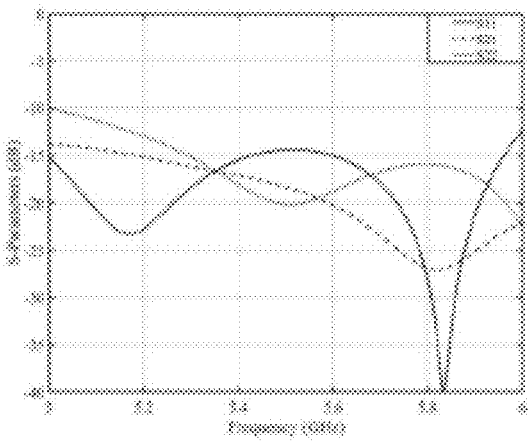
Figure 18F:
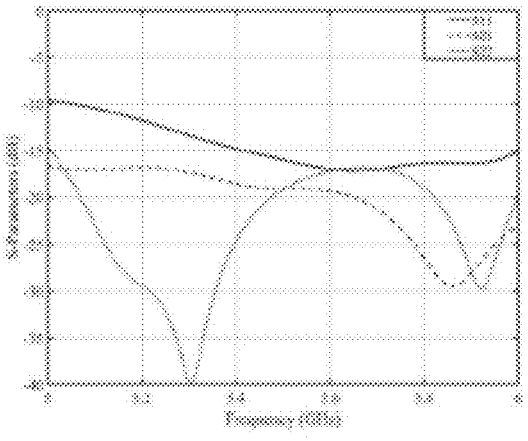

FIG. 16A shows the dual-port reconfigurable planar antenna system 1520 of FIG. 15C, in accordance with some embodiments. Each of the switching elements 1527 are individually numbered from 1-49. In an embodiment, each of the switching elements 1527 comprises a PIN diode. By switching the PIN diodes 'on' or 'off,' a wide range of distinct pixel configurations can be realized, which are used to alter the direction of the beam of radiation generated by the dipole antennas 1522, 1524.

In an embodiment, the pixel configuration can be calculated or determined based on an algorithm referred to as internal multiport method (IMPM). In IMPM, the grid of parasitic elements 1526 and dipole antennas 1522, 1524 are treated as a multiport network, and only one full electromagnetic (EM) computation is needed to obtain an initial impedance matrix with all PIN diodes set to the 'off' state. Network circuit analysis can be performed by treating each pixel port as open, short, or an equivalent circuit component such as a switch. With the aid of an optimization genetic algorithm (GA), the radiation beams generated by dipole antennas 1522, 1524 can be steered at different angles in accordance with different pixel configurations. The GA refers to a search algorithm based on the theory of natural evolution. The GA reflects the process of natural selection where the fittest individuals are selected for reproduction in order to produce offspring of the next generation. The objective functions in GA can be set to optimize multiple antenna reflections, mutual couplings between antennas, and a required beam direction of an individual antenna simultaneously.

FIG. 16B depicts a table 1600 indicating a configuration of switches of the antenna system 1520 corresponding to different beam directions, in accordance with some embodiments. The listed indices of the PIN diodes in the table 1600 indicate which PIN diodes are set to an 'on' state. Those indices omitted from a table entry are set to an 'off' state. The table 1600 lists configurations of the switching elements 1526 corresponding to azimuth angles of 0°, 30°, 60°, 90°, 300°, and 330° in the right half space. By considering a mirror image of the PIN diode configurations given in table 1600, a directional beam steered at the left half space is also possible due to the symmetric geometry. The antenna system 1520 can provide 300° of end-fire beam steering in total.

FIGS. 17A-17F depict graphs of a simulated frequency response of the of the antenna system 1520 corresponding to the beam direction of Φ=0°, 30°, 60°, 90°, 300°, and 330°, respectively, in accordance with some embodiments. The graphs each represent different beam direction angles.

FIGS. 18A-18F depict graphs of a measured frequency response of the of the antenna system 1520 corresponding to the beam direction of Φ=0°, 30°, 60°, 90°, 300°, and 330°, respectively, in accordance with some embodiments. The graphs each represent different beam direction angles.

FIGS. 19A-19F depict graphs of a simulated total E-field pattern of the of the antenna system 1520 corresponding to the beam direction of Φ=0°, 30°, 60°, 90°, 300°, and 330°, respectively, in accordance with some embodiments. The graphs each represent different beam direction angles. The solid and dashed lines correspond to port 1 and port 2, respectively.

FIGS. 20A-20F depict graphs of a measured total E-field pattern of the of the antenna system 1520 corresponding to the beam direction of Φ=0°, 30°, 60°, 90°, 300°, and 330°, respectively, in accordance with some embodiments. The graphs each represent different beam direction angles. The solid and dashed lines correspond to port 1 and port 2, respectively.

It is noted that the techniques described herein for determining a configuration of parasitic elements may be embodied in executable instructions stored in a computer readable medium for use by or in connection with a processor-based instruction execution machine, system, apparatus, or device. It will be appreciated by those skilled in the art that, for some embodiments, various types of computer-readable media can be included for storing data. As used herein, a "computer-readable medium" includes one or more of any suitable media for storing the executable instructions of a computer program such that the instruction execution machine, system, apparatus, or device may read (or fetch) the instructions from the computer-readable medium and execute the instructions for carrying out the described embodiments. Suitable storage formats include one or more of an electronic, magnetic, optical, and electromagnetic format. A non-exhaustive list of conventional exemplary computer-readable medium includes: a portable computer diskette; a random-access memory (RAM); a read-only memory (ROM); an erasable programmable read only memory (EPROM); a flash memory device; and optical storage devices, including a portable compact disc (CD), a portable digital video disc (DVD), and the like.

It should be understood that the arrangement of components illustrated in the attached Figures are for illustrative purposes and that other arrangements are possible. For example, one or more of the elements described herein may be realized, in whole or in part, as an electronic hardware component. Other elements may be implemented in software, hardware, or a combination of software and hardware. Moreover, some or all of these other elements may be combined, some may be omitted altogether, and additional components may be added while still achieving the functionality described herein. Thus, the subject matter described herein may be embodied in many different variations, and all such variations are contemplated to be within the scope of the claims.

To facilitate an understanding of the subject matter described herein, many aspects are described in terms of sequences of actions. It will be recognized by those skilled in the art that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar references in the context of describing the subject matter (particularly in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. Furthermore, the foregoing description is for the purpose of illustration only, and not for the purpose of limitation, as the scope of protection sought is defined by the claims as set forth hereinafter together with any equivalents thereof. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the embodiments as claimed.

What is claimed is:

1. An apparatus comprising:

a substrate;

at least one radiating element formed on a surface of the substrate, each radiating element driven by a radio frequency (RF) signal, wherein the at least one radiating element comprises two or more dipole antennas, each dipole antenna corresponding to a different port of the apparatus; and a plurality of parasitic elements formed on the substrate proximate the at least one radiating element; and a plurality of switching elements, wherein each switching element in the plurality of switching elements corresponds to at least one parasitic element in the plurality of parasitic elements.

2. The apparatus of claim 1, wherein the plurality of parasitic elements comprises a grid of metallic pixels having a number of rows and a number of columns, and wherein each radiating element of the at least one radiating element is located adjacent an outer row or an outer column of the grid of metallic pixels.

3. The apparatus of claim 2, wherein a first radiating element is located next to a first row of the grid and a second radiating element is located next to a second row of the grid that is opposite the first row.

4. The apparatus of claim 2, wherein a first radiating element is located next to a first row of the grid and a second radiating element is located next to a first column of the grid.

5. The apparatus of claim 1, wherein the at least one radiating element comprises four dipole antennas, and wherein the plurality of parasitic elements comprise one or more rings of parasitic elements.

6. The apparatus of claim 5, wherein the plurality of parasitic elements comprise four rings of parasitic elements, wherein a first ring is an inner most ring closest to the four dipole antennas, a second ring is adjacent the first ring, a third ring is adjacent the second ring, and a fourth ring is an outer most ring furthest away from the four dipole antennas, and wherein the plurality of switching elements comprise PIN diodes connecting parasitic elements in the first ring, the second ring, and the third ring, and wherein hardwired inductors connect parasitic elements in the fourth ring to corresponding parasitic elements in the fourth ring as well as parasitic elements in the third ring.

7. The apparatus of claim 1, further comprising at least one additional radiating element formed on a second substrate, wherein the first substrate and the second substrate are arranged in a stacked configuration and separated by a distance, wherein the at least one additional radiating element comprises a monopole antenna, and wherein the plurality of parasitic elements comprise one or more rings of parasitic elements.

8. The apparatus of claim 7, wherein each parasitic element comprises a first portion and a second portion, and wherein the first portion is connected to the second portion via a switching element.

9. The apparatus of claim 1, wherein the plurality of switching elements comprise PIN diodes.

10. The apparatus of claim 1, wherein the plurality of switching elements comprise field effect transistors (FETs).

11. The apparatus of claim 1, wherein the plurality of switching elements comprise micro-electromechanical systems (MEMS) devices.

12. A system comprising:

a first antenna system comprising a planar antenna configured to generate a radiation pattern in accordance with a first polarization;

a second antenna system comprising a planar antenna configured to generate a radiation pattern in accordance with a second polarization that is orthogonal to the first polarization, and a controller configured to generate direct current (DC) signals corresponding to a plurality of switching elements, wherein the plurality of switching elements are connected to one or more parasitic elements in each of the first antenna system or the second antenna system wherein the first antenna system includes a first substrate and the second antenna system includes a second substrate, and the first substrate and the second substrate are arranged in a stacked configuration and separated by a distance.

13. The system of claim 12, further comprising a power source and circuitry disposed between the first substrate and the second substrate.

14. The system of claim 12, wherein the first antenna system comprises the apparatus of claim 6, and wherein the second antenna system comprises the apparatus of claim 8.

15. The system of claim 12, wherein the first antenna system and the second antenna system comprise switching elements connected to a plurality of parasitic elements arranged proximate one or more radiating elements, wherein each switching element comprises a PIN diode.

16. The system of claim 12, wherein the first substrate and the second substrate comprise a glass-reinforced epoxy.

17. The system of claim 16, wherein a photolithographic process is used to form the planar antennas on the first substrate and the second substrate, and the planar antennas are primarily made of a copper material.

18. The system of claim 12, wherein the first antenna system is configured to generate a first beam of radiation in a first direction according to a first RF signal, and wherein the second antenna system is configured to generate a second beam of radiation in a second direction according to a second RF signal, and the first direction is not equal to the second direction.

* * * * *